US010571821B2

(12) United States Patent
Kodama et al.

(10) Patent No.: US 10,571,821 B2
(45) Date of Patent: Feb. 25, 2020

(54) ELECTROPHOTOGRAPHIC IMAGE FORMING APPARATUS

(71) Applicant: Konica Minolta, Inc., Tokyo (JP)

(72) Inventors: Daisuke Kodama, Hachioji (JP); Keiichi Inagaki, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/183,312

(22) Filed: Nov. 7, 2018

(65) Prior Publication Data

US 2019/0196353 A1 Jun. 27, 2019

(30) Foreign Application Priority Data

Dec. 22, 2017 (JP) ..... 2017-246263

(51) Int. Cl.

| | |
|---|---|
| ***G03G 15/00*** | (2006.01) |
| ***G03G 15/01*** | (2006.01) |
| ***G03G 21/00*** | (2006.01) |
| ***G03G 5/147*** | (2006.01) |

(52) U.S. Cl.

CPC ..... *G03G 15/0178* (2013.01); *G03G 5/14713* (2013.01); *G03G 15/011* (2013.01); *G03G 15/75* (2013.01); *G03G 21/0011* (2013.01); *G03G 2215/0103* (2013.01)

(58) Field of Classification Search

CPC .. G03G 15/0178; G03G 15/011; G03G 15/75; G03G 5/14713; G03G 21/0011; G03G 21/0017; G03G 2215/0103

See application file for complete search history.

(56) References Cited

U.S. PATENT DOCUMENTS

2007/0020005 A1* 1/2007 Shigezaki ..... G03G 21/0017 399/349
2013/0071163 A1* 3/2013 Watanabe ..... G03G 15/0189 399/346
2015/0010339 A1* 1/2015 Ichijo ..... G03G 21/0017 399/350

FOREIGN PATENT DOCUMENTS

JP 2005208325 A 8/2005

* cited by examiner

*Primary Examiner* — Hoang X Ngo
(74) *Attorney, Agent, or Firm* — Lucas & Mercanti, LLP

(57) ABSTRACT

Provided is a means in which in a tandem type electrophotographic image forming apparatus, image deletion of a formed image is suppressed, passing through of a toner is suppressed, and the lifetime of an organic photoreceptor and the apparatus itself is prolonged. The invention relates to a tandem type electrophotographic image forming apparatus using an organic photoreceptor in which at least a charge generating layer and a charge transfer layer are sequentially laminated on a conductive support body, in which in at least one of combinations of two adjacent image forming units including toners having colors different from each other, a linear pressure P1 of a cleaning blade A included in the image forming unit disposed on an upstream side, and a linear pressure P2 of a cleaning unit blade B included in the image forming unit disposed on a downstream side, satisfy a predetermined relationship.

12 Claims, 5 Drawing Sheets

ELECTROPHOTOGRAPHIC IMAGE FORMING APPARATUS

CROSS-REFERENCE TO RELATED APPLICATION

The entire disclosure of Japanese Patent Application No. 2017-246263, filed on Dec. 22, 2017, is incorporated herein by reference in its entirety.

BACKGROUND

1. Technical Field

The present invention relates to an electrophotographic image forming apparatus.

2. Description of the Related Arts

In an electrophotographic image forming apparatus, an electrophotographic photoreceptor for forming an electrostatic latent image corresponding to an image to be formed (hereinafter, simply referred to as a "photoreceptor") has been used. A front surface of the photoreceptor is charged by a charging member of an image forming apparatus. The electrostatic latent image is formed by irradiating the charged front surface of the photoreceptor with light. In a case where a toner is supplied to the photoreceptor on which the electrostatic latent image is formed, a toner image is formed. The toner image is transferred to a recording medium. The toner remaining on the front surface of the photoreceptor after the transfer, is removed by a cleaning member of the image forming apparatus. An organic photoreceptor including a conductive support body, an organic photosensitive layer disposed on the conductive support body, and a protective layer disposed on the organic photosensitive layer, is known as the photoreceptor.

A cured surface layer is excellent in wear resistance or abrasion resistance, and thus, functions as a protective layer, and is capable of reducing a wear amount of the front surface of the organic photoreceptor due to a cleaning blade at the time of cleaning the organic photoreceptor, and therefore, contributes to long lifetime of the organic photoreceptor. However, even though the protective layer is excellent in the wear resistance or the abrasion resistance, a scratch occurs, and the cleaning blade is deformed, and thus, there is a case where an occurrence frequency of passing through of the toner increases.

Here, from the viewpoint of further reducing the wear amount of the front surface of the organic photoreceptor, attempts have been made to solve the problems described above, and the optimization of physical properties of the protective layer has been studied. In Japanese Patent Application Laid-Open No. 2005-208325, an image forming apparatus is disclosed in which an image carrier includes a surface layer containing a curable resin, a universal hardness and an elastic deformation rate of the image carrier are in a predetermined range, a plurality of developing means involving developers of colors different from each other, is provided, at least one of the plurality of developing means includes polishing particles in the developer, and a rubbing member rubbing the image carrier, and a cleaning blade are provided as a cleaning means of the image carrier after the transfer. Here, the polishing particles have an effect of increasing cleaning properties. In Japanese Patent Application Laid-Open No. 2005-208325, in the image forming apparatus, it is disclosed that the universal hardness and the elastic deformation rate are controlled such that the universal hardness and the elastic deformation rate are in the predetermined range, and thus, a mechanical deterioration of a surface layer of a photoreceptor rarely occurs, and such a technology is capable of contributing to the prevention of the accumulation of a discharge product or the like, in particular, the prevention of image deletion under a high humidity environment.

SUMMARY

However, as with the technology of Japanese Patent Application Laid-Open No. 2005-208325, even in a case where the physical properties of the protective layer are optimized, in the tandem type electrophotographic image forming apparatus, there is a case where in at least one of an organic photoreceptor disposed on an upstream side and an organic photoreceptor disposed on a downstream side, the wear amount of the front surface of the organic photoreceptor is not sufficiently reduced, the lifetime of the organic photoreceptor is not sufficient, and the passing through of the toner easily occurs. Thus, in the tandem type electrophotographic image forming apparatus, there is still a problem that the lifetime is not capable of being prolonged, and the passing through of the toner easily occurs, in a the plurality of organic photoreceptors.

Therefore, an object of the invention is to provide a means in which in a tandem type electrophotographic image forming apparatus, image deletion of a formed image is suppressed, passing through of a toner is suppressed, and the lifetime of an organic photoreceptor and the apparatus itself is prolonged.

One embodiment of the invention, which is one of means for attaining the object described above, has the following configuration.

A tandem type electrophotographic image forming apparatus using an organic photoreceptor in which at least a charge generating layer and a charge transfer layer are sequentially laminated on a conductive support body, the apparatus including at least: a plurality of image forming units including an electrostatic latent image forming means forming an electrostatic latent image on the organic photoreceptor, a developing means forming a toner image by supplying a toner to the organic photoreceptor, and by developing the electrostatic latent image, a lubricant supplying means supplying a lubricant to a front surface of the organic photoreceptor, and a cleaning means removing the toner remaining on the front surface of the organic photoreceptor with a cleaning blade, in which when a linear pressure of a cleaning blade A included in the image forming unit disposed on an upstream side, is set to P1, and a linear pressure of a cleaning blade B included in the image forming unit disposed on a downstream side, is set to P2, at least one of combinations of two adjacent image forming units including toners having colors different from each other satisfies Equation (1) described below.

[Expression 1]

$$P2>P1 \quad (1)$$

BRIEF DESCRIPTION OF THE DRAWING

The advantages and features provided by one or more embodiments of the invention will become more fully understood from the detailed description given hereinbelow and the appended drawings which are given by way of illustration of each embodiment only, and thus are not intended as a definition of the limits of the present invention.

DETAILED DESCRIPTION OF THE EMBODIMENTS

Figure 1:
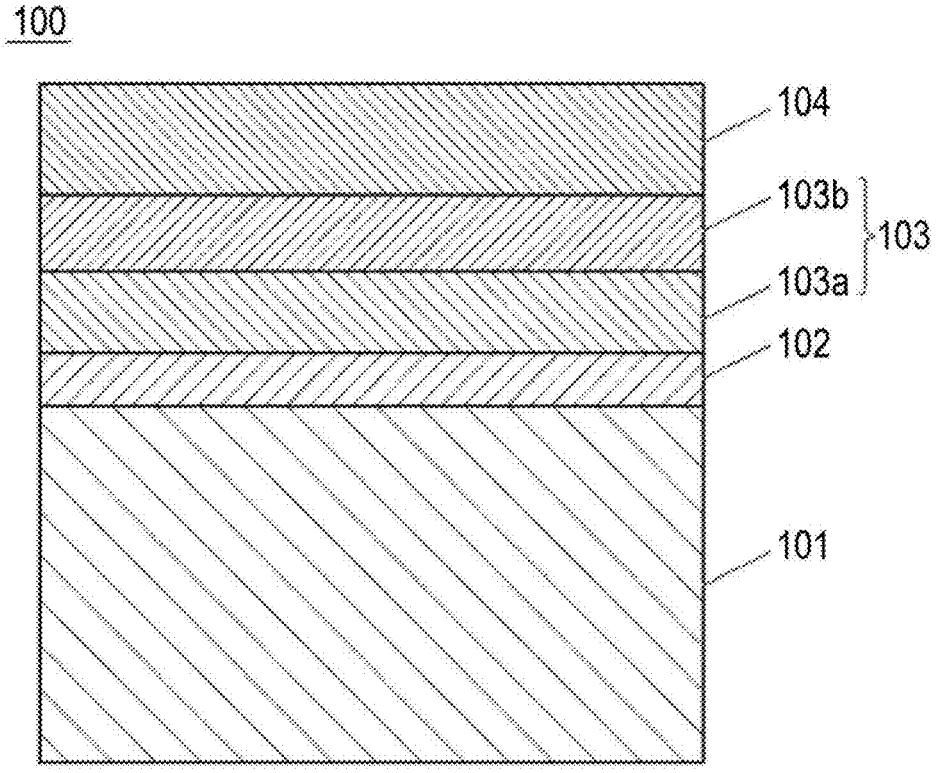
FIG. 1 is a meansal schematic view illustrating a structure of an organic photoreceptor, in a tandem type electrophotographic image forming apparatus according to one embodiment of the invention.

Hereinafter, one or more embodiments of the invention will be described while referring to the drawings, as necessary. However, the scope of the invention is not limited to the disclosed embodiments.

Hereinafter, preferred embodiments of the invention will be described. Herein, "X to Y" indicating a range indicates "greater than or equal to X and less than or equal to Y". In addition, unless otherwise noted, manipulations, physical properties, and the like, are measured in a condition of a room temperature (20° C. to 25° C.)/relative humidity of 40% RH to 50% RH. In addition, herein, "(meth)acryl" indicates methacryl and/or acryl.

Hereinafter, the embodiments of the invention will be described with reference to the attached drawings. Furthermore, in the description of the drawings, the same reference numerals will be applied to the same constituents, and the repeated description thereof will be omitted. In addition, dimension ratios of the drawings are exaggerated for convenience of explanation and may differ from the actual ratios.

One embodiment of the invention relates to a tandem type electrophotographic image forming apparatus using an organic photoreceptor in which at least a charge generating layer and a charge transfer layer are sequentially laminated on a conductive support body, the apparatus including at least: a plurality of image forming units including an electrostatic latent image forming means forming an electrostatic latent image on the organic photoreceptor, a developing means forming a toner image by supplying a toner to the organic photoreceptor, and by developing the electrostatic latent image, a lubricant supplying means supplying a lubricant to a front surface of the organic photoreceptor, and a cleaning means removing the toner remaining on the front surface of the organic photoreceptor with a cleaning blade, in which when a linear pressure of a cleaning blade A included in the image forming unit disposed on an upstream side, is set to P1, and a linear pressure of a cleaning blade B included in the image forming unit disposed on a downstream side, is set to P2, at least one of combinations of two adjacent image forming units including toners having colors different from each other satisfies Equation (1) described below.

[Expression 2]

$$P2>P1 \quad (1)$$

According to one embodiment of the invention, a means is provided, in which in the tandem type electrophotographic image forming apparatus, the passing through of the toner is suppressed, and the lifetime of the organic photoreceptor and the apparatus itself is prolonged.

The inventors have assumed the mechanism in which the object is attained by the configuration described above, as follows.

Impurities including the remaining toner rigidly attached onto the front surface of the organic photoreceptor, are scraped out and removed by the cleaning blade, along with an extremely thin region on the front surface of the organic photoreceptor, and thus, the cleaning of the organic photoreceptor is performed.

In the tandem type electrophotographic image forming apparatus, reverse transfer occurs in which the toner transferred to an intermediate transfer belt from the organic photoreceptor disposed on the upstream side, is transferred to a non-image portion of the organic photoreceptor disposed on the downstream side. At this time, the amount of toner to be reversely transferred (a reverse transfer toner) increases in the organic photoreceptor disposed on the downstream side, and the amount of toner reaching the cleaning blade cleaning the organic photoreceptor, increases. Accordingly, in the organic photoreceptor disposed on the downstream side, it is difficult to sufficiently suppress the passing through of the toner.

A method of increasing the linear pressure of the cleaning blade, is considered as a method of sufficiently removing the reverse transfer toner in the organic photoreceptor disposed on the downstream side, and of more excellently suppressing the passing through of the toner.

However, in a case of uniformly increasing only the linear pressure of the cleaning blade, in the organic photoreceptor disposed on the upstream side, having less reverse transfer toner, a load more than necessary, is applied to the front surface of the organic photoreceptor and the cleaning blade. Accordingly, sliding properties of the front surface of the organic photoreceptor decrease, and deterioration due to the wear of the cleaning blade, becomes remarkable, and thus, the passing through of the toner occurs. In addition, the wear amount of the front surface of the organic photoreceptor disposed on the upstream side excessively increases. In addition, there is also a case where the lifetime of the organic photoreceptor is shortened.

Examples of a means for suppressing the load of the front surface of the organic photoreceptor and the cleaning blade include the supply of the lubricant with respect to the front surface of the organic photoreceptor. However, in the organic photoreceptor disposed on the upstream side, of the tandem type electrophotographic image forming apparatus, as described above, the load of the front surface of the organic photoreceptor and the cleaning blade extremely increases by uniformly increasing the linear pressure of the cleaning blade. For this reason, even in a case where the lubricant is supplied to the front surface of the organic photoreceptor, most of the lubricant existing on the front surface of the organic photoreceptor, is scraped out and removed by the cleaning blade. At this time, as with a case of not using the lubricant, in the organic photoreceptor disposed on the upstream side, the passing through of the toner easily occurs. In addition, there is also a case where the lifetime of the organic photoreceptor is shortened.

On the other hand, in the tandem type electrophotographic image forming apparatus according to the invention, the linear pressure of the cleaning blade included in the image forming unit disposed on the downstream side, has a value higher than that of the linear pressure of the cleaning blade included in the image forming unit disposed on the upstream side. Accordingly, in the image forming unit disposed on the upstream side, in which the lubricant easily becomes insufficient, it is possible to suppress the wear of the cleaning blade, and to suppress excessive wear of the organic photoreceptor, while realizing the linear pressure of the cleaning blade sufficiently cleaning the organic photoreceptor disposed on the downstream side.

Thus, according to the invention, a relationship in the amounts of reverse transfer toner, different from each other according to the disposition of each of the organic photoreceptors of the tandem type electrophotographic image forming apparatus, the amounts of lubricant, different from each other, which is capable of existing on the organic photoreceptor, and the linear pressure of the cleaning blade included in each of the image forming units, is optimized. Accordingly, in the tandem type electrophotographic image forming apparatus according to the invention, in the organic photoreceptor included in the plurality of image forming units, the passing through of the toner is suppressed, and the lifetime of the organic photoreceptor and the apparatus itself is prolonged.

Furthermore, the mechanism described above is based on the assumption, and the right or wrong thereof does not affect the technical scope of the invention.

<Organic Photoreceptor>

The organic photoreceptor indicates an electrophotographic photoreceptor in which an organic compound has at least one function of a charge generating function and a charge transfer function, which are requisite for the configuration of the electrophotographic photoreceptor, and includes a known organic photoreceptor such as a photoreceptor configured of a known organic charge generating substance or organic charge transfer substance, and a photoreceptor in which a polymer complex has a charge generating function and a charge transfer function.

In the tandem type electrophotographic image forming apparatus according to one embodiment of the invention, a universal hardness (HU) measured from the outermost surface layer side (for example, the charge transfer layer side or the protective layer side) of all of the organic photoreceptors, is not particularly limited, but is preferably in a range of 180 $N/mm^2$ to 320 $N/mm^2$, and is more preferably in a range of 220 $N/mm^2$ to 320 $N/mm^2$. According to the range described above, excessive wear rarely occurs with respect to an abrasive force of the cleaning blade, and it is possible to more suitably refresh the front surface.

The universal hardness can be measured by using a commercially available hardness measurement device, and can be measured by using an ultra-microhardness tester "H-100V" (manufactured by Fischer Instruments K.K.).

Furthermore, the details a measurement method and a calculation method of the universal hardness will be described in examples.

The universal hardness measured from the outermost surface layer side of the organic photoreceptor, in particular, can be controlled by disposing the protective layer as the outermost layer, and by adjusting the type or the content of a material configuring the outermost surface layer, a condition in a case of performing a polymerization reaction, or the like.

[Configuration of Organic Photoreceptor]

Hereinafter, the electrophotographic image forming apparatus according to one embodiment of the invention will be described with reference to the attached drawings. Here, the invention is not limited to one embodiment described below.

FIG. 1 is a meansal schematic view illustrating the structure of the organic photoreceptor in the tandem type electrophotographic image forming apparatus according to one embodiment of the invention.

In the tandem type electrophotographic image forming apparatus according to one embodiment of the invention, an organic photoreceptor 100 has a structure in which at least a charge generating layer 103*a*, and a charge transfer layer 103*b* are sequentially laminated on a conductive support body 101. Here, in a case where the organic photoreceptor has a laminated structure in which the charge generating layer 103*a* and the charge transfer layer 103*b* are directly laminated, the laminated structure portion will be also referred to as an organic photosensitive layer 103.

In addition, in the tandem type electrophotographic image forming apparatus according to one embodiment of the invention, in at least one of combinations of two adjacent image forming units including toners having colors different from each other, it is preferable that at least one of an organic photoreceptor C included in the image forming unit disposed on the upstream side, and an organic photoreceptor D included in the image forming unit disposed on the downstream side includes the protective layer as the outermost surface layer, and it is more preferable that both of the organic photoreceptor C and the organic photoreceptor D include the protective layer as the outermost surface layer. At this time, as illustrated in FIG. 1, the organic photoreceptor 100 including the protective layer, has a structure in which at least the charge generating layer 103*a*, the charge transfer layer 103*b*, and a protective layer 104 are sequentially laminated on the conductive support body 101, and the protective layer 104 is the outermost surface layer. Among them, in at least two of the combinations of the two adjacent image forming units including the toners having colors different from each other, it is preferable that at least one of the organic photoreceptor C and the organic photoreceptor D includes the protective layer as the outermost surface layer, and is it more preferable that both of the organic photoreceptor C and the organic photoreceptor D include the protective layer as the outermost surface layer. In addition, in at least three of the combinations of the two adjacent image forming units including the toners having colors different from each other, it is preferable that at least one of the organic photoreceptor C and the organic photoreceptor D includes the protective layer as the outermost surface layer, and it is more preferable that both of the organic photoreceptor C and the organic photoreceptor D include the protective layer as the outermost surface layer. Then, it is particularly preferable that the organic photoreceptors included in all of the image forming units include the protective layer as the outermost surface layer. In such cases, the organic photoreceptor includes the protective layer as the outermost layer, and thus, in the two adjacent image forming units including the toners having colors different from each other, a difference in the universal hardness between the organic photoreceptor C and the organic photoreceptor D, is more easily controlled such that the difference is in a range satisfying Equation (4) described below.

Furthermore, as illustrated in FIG. 1, the organic photoreceptor 100 may include an interlayer 102 between the conductive support body 101 and the charge generating layer 103*a*.

Hereinafter, the details of each of the layers configuring the organic photoreceptor, will be described.

[Protective Layer]

It is preferable that the organic photoreceptor includes the protective layer as the outermost surface layer on a side opposite to the conductive support body side. The protective layer improves low wear properties or scratch resistance of the front surface of the organic photoreceptor, reduces the occurrence of the passing through of the toner, and contributes to long lifetime of the organic photoreceptor and the electrophotographic image forming apparatus.

It is more preferable that in the tandem type electrophotographic image forming apparatus according to one embodiment of the invention, at least one organic photoreceptor further includes the protective layer as the outermost surface. The universal hardness (HU) measured from the outermost surface layer side (the protective layer side) of the organic photoreceptor including the protective layer as the outermost surface, is not particularly limited, but is preferably 220 $N/mm^2$ to 320 $N/mm^2$. According to the range described above, a scratch rarely occurs with respect to the abrasive force of the cleaning blade, and it is possible to more suitably refresh the front surface. Furthermore, the measurement method and the calculation method of the universal hardness are as described above.

A film thickness of the protective layer is not particularly limited, but is preferably 0.2 μm to 10 μm, and is more preferably 0.5 μm to 6 μm.

The universal hardness measured from the outermost surface layer side (the protective layer side) of the organic photoreceptor including the protective layer as the outermost surface, can be controlled by adjusting the type or the content of the material configuring the protective layer, the condition in a case of performing the polymerization reaction, or the like. Furthermore, it is preferable that the protective layer contains a cured resin component described below, and it is more preferable that a polymerization reaction for obtaining a cured resin is performed in the presence of a specific radical scavenger described below, from the viewpoint of setting the universal hardness to be in the range described above. This is because it is possible to adjust a cross-linking reaction in the polymerization reaction, and to easily control a cross-linking density (that is, the universal hardness) of a polymer, by using the specific radical scavenger.

Hereinafter, the details of each component of a protective layer forming material, will be described.

(Cured Resin Component)

It is preferable that the protective layer contains the cured resin component, which is a cured material of a polymerizable compound, from the viewpoint of low wear properties or the scratch resistance. The polymerizable compound is polymerized and cured by being irradiated with an active ray such as an ultraviolet ray or an electron ray, and thus, the cured resin component configuring the protective layer, can be obtained. A monomer having two or more polymerizable functional groups (a polyfunctional polymerizable compound) can be used, and a monomer having one polymerizable functional group (a monofunctional polymerizable compound) can be used together, as the polymerizable compound. Specifically, examples of the polymerizable compound include a styrene-based monomer, an acrylic monomer, a (meth)acrylic monomer, a vinyl toluene-based monomer, a vinyl acetate-based monomer, an N-vinyl pyrrolidone-based monomer, and the like.

From the viewpoint of being cured with less light intensity or for a short time, a (meth)acrylic monomer having two or more acryloyl groups ($CH_2{=}CHCO{-}$) or methacryloyl groups ($CH_2{=}CCH_3CO{-}$), or an oligomer thereof is particularly preferable as the polymerizable compound.

In the invention, the polymerizable compounds may be independently used, or may be used by being mixed. In addition, a monomer, or an oligomer thereof may be used as the polymerizable compounds.

Hereinafter, a preferred specific example of the polymerizable compound will be represented.

[Chemical Formula 1]

M1

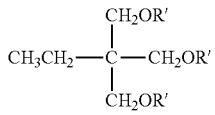

M2

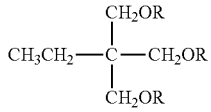

M3

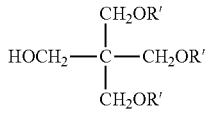

M4

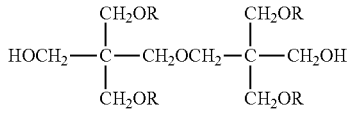

M5

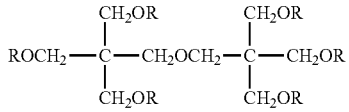

M6

$CH_3CH_2C{-}(CH_2OC_3H_5OR)_3$

M7

$CH_3CH_2C{-}(CH_2CH_2OR)_3$

[Chemical Formula 2]

M8

$R{-}(OC_3H_6)_5{-}OR$

M9

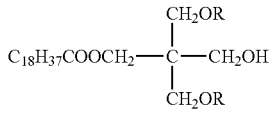

M10

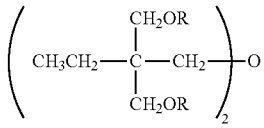

M11

$(ROCH_2)_4C$

M12

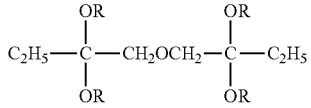

-continued

M13

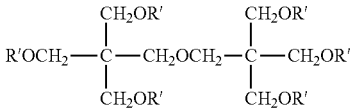

M14

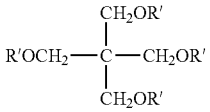

Here, in the chemical formula representing the exemplary compounds (M1) to (M14) described above, R represents an acryloyl group ($CH_2{=}CHCO{-}$), and R represents a methacryloyl group ($CH_2{=}CCH_3CO{-}$).

It is preferable that a monomer having three or more polymerizable functional groups, is used as the polymerizable compound. In addition, two or more types of compounds may be used together as the polymerizable compound, and in such a case, it is preferable that the monomer having three or more polymerizable functional groups is used at a rate of greater than or equal to 50 mass %.

Only one type of polymerizable compounds and cured resin components may be independently used, or two or more types thereof may be used by being mixed.

(Metal Oxide Particles)

It is preferable that the protective layer contains metal oxide particles.

The metal oxide particles contribute to the improvement of the strength of the protective layer or image quality stability according to the adjustment of resistance.

A number average primary particle diameter of the metal oxide particles is preferably 1 nm to 300 nm, is more preferably 3 nm to 100 nm, and is even more preferably 5 nm to 40 nm.

The number average primary particle diameter of the metal oxide particles can be calculated by capturing a 10000 times magnified picture with a scanning type electron microscope (manufactured by JEOL Ltd.), and by analyzing a picture image (excluding flocculated particles) in which 300 particles are randomly captured by a scanner, with an automatic image processing analyzer "LUZEX AP (software version Ver.1.32)" (manufactured by NIRECO CORPORATION).

For example, silica (silicon oxide), magnesium oxide, zinc oxide, lead oxide, alumina (aluminum oxide), zirconium oxide, tin oxide, titania (titanium oxide), niobium oxide, molybdenum oxide, vanadium oxide, and the like, can be used as the metal oxide particles configuring the protective layer. Among them, tin oxide is preferable from the viewpoint of electrical properties.

The metal oxide particles are not particularly limited, and particles prepared by a known manufacturing method, can be used as the metal oxide particles.

The metal oxide particles may be subjected to surface modification by a surface modifier having a reactive organic group (hereinafter, also referred to as a "reactive organic group-containing surface modifier").

A surface modifier that reacts with a hydroxy group or the like, existing on the front surface of the metal oxide particles, is preferable as the reactive organic group-containing surface modifier, and examples of the reactive organic group-containing surface modifier include a silane coupling agent, a titanium coupling agent, and the like.

In addition, a surface modifier having a radical polymerizable reactive group is preferable as the reactive organic group-containing surface modifier. Examples of the radical polymerizable reactive group include a vinyl group, an acryloyl group, a methacryloyl group, and the like. Such a radical polymerizable reactive group also reacts with a polymerizable compound, and thus, is capable of forming a rigid protective layer. A silane coupling agent having a radical polymerizable reactive group such as a vinyl group, an acryloyl group, and a methacryloyl group, is preferable as the surface modifier having a radical polymerizable reactive group.

The silane coupling agent having a radical polymerizable group, described above, is preferable as the reactive organic group-containing surface modifier, and examples of the reactive organic group-containing surface modifier include compounds S-1 to S-31 described below.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$
S-31: $CH_2{=}CHCOO(CH_2)_2Si(CH_3)_2(OCH_3)$

In addition, a silane compound having a radical polymerizable reactive organic group, may be used as the reactive organic group-containing surface modifier, in addition to the exemplary compounds (S-1) to (S-31) described above. Only one type of reactive organic group-containing surface modifiers may be independently use, or two or more types thereof may be used by being mixed. A treated amount (an added amount) of the reactive organic group-containing surface modifier, is preferably 0.1 parts by mass to 200 parts by mass, and is more preferably 7 parts by mass to 70 parts by mass, with respect to 100 parts by mass of the particles.

A treatment method of the reactive organic group-containing surface modifier with respect to the untreated metal oxide particles, is not particularly limited, but examples of the treatment method include a method of wet-grinding slurry including the untreated metal oxide particles and the reactive organic group-containing surface modifier (a suspension liquid of solid particles), and the like. According to such a method, the surface modification of the untreated metal oxide particles progresses while preventing the reflocculation of the untreated metal oxide particles. After that, a solvent is removed, and powdering is performed.

Examples of a surface modification device include a wet media dispersion type device. The wet media dispersion type device is a device including a step of filling a vessel with beads as medium, of rotating a stirring disk attached perpendicular to a rotation axis at a high rate, of crushing the flocculated particles of the untreated metal oxide particles, and of pulverizing and dispersing the crushed particles. The type of wet media dispersion type device is not limited insofar as the device is capable of sufficiently dispersing the untreated metal oxide particles, and of performing surface modification at the time of performing the surface modification with respect to the untreated metal oxide particles, and for example, various types such as a vertical/horizontal type and a continuous/batch type, can be adopted. Specifically, a sand mill, an ultra visco mill, a pearl mill, a glen mill, a dyno mill, an agitator mill, a dynamic mill, and the like are exemplified. In such dispersion type devices, fine pulverization and dispersion are performed according to a ball, impact crushing, friction, shear, a shear stress, and the like, by using a pulverization medium (media) such as beads.

A ball in which glass, alumina, zircon, zirconia, steel, flint, and the like are used as a raw material, can be used as the beads used in the wet media dispersion type device, and in particular, a ball of zirconia or zircon is preferable. In addition, generally, a diameter of approximately 0.1 mm to 2 mm is used as the size of the beads, and it is preferable to use a diameter of approximately 0.1 mm to 1 mm.

Various material such as stainless steel, nylon, and ceramic, can be used in a disk or a vessel inner wall used in the wet media dispersion type device, and in particular, a disk or a vessel inner wall of ceramic such as zirconia or silicon carbide is preferable.

Only one type of metal oxide particles may be independently used, or two or more types thereof may be used by being mixed.

The content of the metal oxide particles is not particularly limited, but is preferably 100 parts by mass to 200 parts by mass, and is more preferably 110 parts by mass to 170 parts by mass, with respect to 100 parts by mass of the polymerizable compound for configuring the cured resin component. According to the range described above, an occurrence frequency of the passing through of the toner further decreases, and the lifetime of the organic photoreceptor and the electrophotographic image forming apparatus is further improved.

(Charge Transfer Substance)

It is preferable that the protective layer contains a charge transfer substance. The charge transfer substance has charge transfer properties of transferring a charge carrier in the protective layer.

The charge transfer substance can be suitably selected from known compounds, and for example, it is preferable that the protective layer contains a charge transfer substance having a structure represented by General Formula (1) described below, from the viewpoint of lowness of scratch resistance, charge injection properties, and a transfer memory occurrence probability.

[Chemical Formula 3]

General Formula (1)

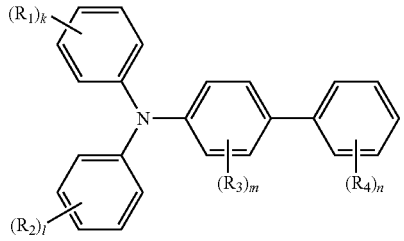

In General Formula (1) described above, $R_1$, $R_2$, $R_3$, and $R_4$ each independently represent an alkyl group having 1 to 7 carbon atoms, or an alkoxy group having 1 to 7 carbon atoms. k, l, and n each independently represent an integer of 0 to 5, and m represents an integer of 0 to 4. Here, in a case where k, l, n, or m is greater than or equal to 2, a plurality of $R_1$s, $R_2$s, $R_3$s, and $R_4$s, may be identical to each other, or different from each other. Among them, it is preferable that $R_1$, $R_2$, $R_3$, and $R_4$ are each independently an alkyl group having 1 to 3 carbon atoms. In addition, it is preferable that k, l, n, and m are each independently an integer of 0 to 1. An example of a preferred compound includes CTM-1 used in the examples.

For example, a compound described Japanese Patent Application Laid-Open No. 2015-114454, can be used as the compound represented by General Formula (1) described above. In addition, a compound can be synthesized by a known synthesis method, for example, a method disclosed in Japanese Patent Application Laid-Open No. 2006-143720 or the like.

Only one type of charge transfer substances may be independently used, or two or more types thereof may be used by being mixed.

An added amount of the charge transfer substance is not particularly limited, but is preferably 1 part by mass to 25 parts by mass, and is more preferably 5 parts by mass to 20 parts by mass, with respect to 100 parts by mass of the polymerizable compound for configuring the cured resin component. According to the range described above, the electrical properties are more excellent, the occurrence frequency of the passing through of the toner further decreases, and the lifetime of the organic photoreceptor and the electrophotographic image forming apparatus is further improved.

Furthermore, it is preferable that the hardness of the protective layer, that is, the universal hardness (HU) measured from the outermost surface layer side (the protective layer side) of the organic photoreceptor including the protective layer as the outermost surface, is controlled by a volume ratio between the polymerizable compound and the charge transfer agent for configuring the cured resin component. Here, when the total volume of the protective layer forming material is set to 100, a volume ratio of the polymerizable compound increases, and a volume ratio of the charge transfer agent decreases, and thus, it is possible to increase the value of the universal hardness.

(Specific Radical Scavenger)

It is preferable that the protective layer contains a radical scavenger having a structure represented by General Formula (2) described below.

It is preferable that the polymerizable compound described above is polymerized in the presence of a specific radical scavenger represented by General Formula (2) described below. The specific radical scavenger functions as a sealant of a cross-linking bond. That is, the specific radical scavenger is capable of adjusting a cross-linking density (that is, the universal hardness) according to an addition ratio or the like. Therefore, the cured resin component is obtained by polymerizing the polymerizable compound in the presence of the specific radical scavenger, and thus, the protective layer has a proper film strength (wear resistance), and the front surface of the organic photoreceptor is properly worn by the cleaning means such as the cleaning blade. For this reason, even though a discharge product or the like is attached onto the front surface of the photoreceptor, the front surface of the organic photoreceptor is worn and refreshed.

[Chemical Formula 4]

General Formula (2)

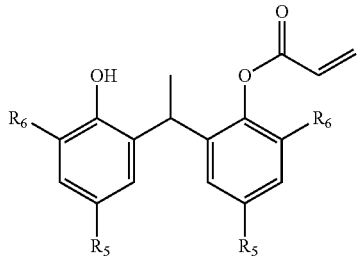

In General Formula (2) described above, $R_5$ and $R_6$ each independently respect an alkyl group having 1 to 6 carbon atoms. In a case where $R_5$ and $R_6$ are the alkyl group having 1 to 6 carbon atoms, it is possible to reduce the influence of steric hindrance of the radical scavenger, and the cross-linking reaction is easily controlled. In addition, it is preferable that $R_5$ and $R_6$ are each independently an alkyl group having 4 or 5 carbon atoms, it is more preferable that $R_5$ and $R_6$ are each independently a tert-butyl group or a tert-pentyl group, and it is even more preferable that $R_5$ and $R_6$ are each independently a tert-pentyl group, from the viewpoint of the stability of the captured radical. Only one type of specific radical scavengers may be independently used, or two or more types thereof may be used by being mixed.

A synthetic product or a commercially available product may be used as the specific radical scavenger, and examples of the commercially available product include SUMILIZER (Registered Trademark) GS, manufactured by Sumitomo Chemical Company, Limited, and the like.

The added amount of the specific radical scavenger is not particularly limited, but is preferably 1 part by mass to 30 parts by mass, and is more preferably 2 parts by mass to 125 parts by mass, with respect to 100 parts by mass of the polymerizable compound for configuring the cured resin component. According to the range described above, the occurrence frequency of the passing through of the toner further decreases, and the lifetime of the organic photoreceptor and the electrophotographic image forming apparatus is further improved.

Furthermore, it is particularly preferable that the hardness of the protective layer, that is, the universal hardness (HU) measured from the outermost surface layer side (the protective layer side) of the organic photoreceptor including the protective layer as the outermost surface, is controlled by the volume ratio between the polymerizable compound and the specific radical scavenger for configuring the cured resin component. Here, when the total volume of the protective layer forming material is set to 100, the volume ratio of the polymerizable compound increases, and the volume ratio of the specific radical scavenger decreases, and thus, it is possible to increase the value of the universal hardness.

(Polymerization Initiator)

It is preferable that the polymerizable compound for configuring the cured resin component described above, is polymerized by using a polymerization initiator.

It is preferable that a radical polymerization initiator is used as the polymerization initiator. The radical polymerization initiator is not particularly limited, but a photopolymerization initiator is preferable, and among them, an acyl phosphine oxide compound, an alkyl phenone compound, an oxime ester compound, and a thioxanthone compound are more preferable, and the acyl phosphine oxide compound and the oxime ester compound are even more preferable. Only one type of polymerization initiators may be independently used, or two or more types thereof may be used by being mixed.

The acyl phosphine oxide compound is not particularly limited, and for example, compounds described below can be preferably used as the acyl phosphine oxide compound.

[Chemical Formula 5]

(P1)

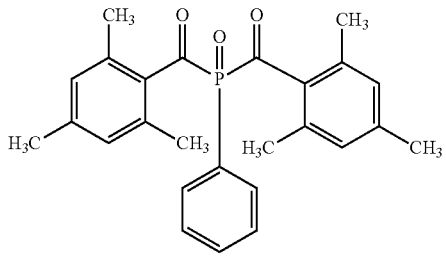

(P2)

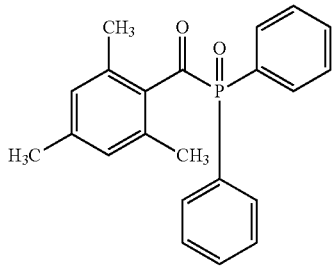

The oxime ester compound is not particularly limited, and for example, compounds described below can be preferably used as the oxime ester compound.

[Chemical Formula 6]

(P3)

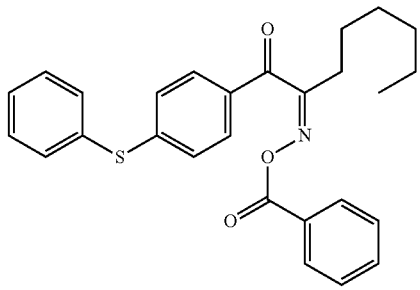

-continued (P4)

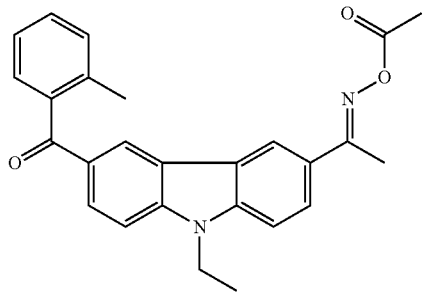

Only one type of polymerization initiators may be independently used, or two or more types thereof may be used by being mixed.

The content of the polymerization initiator is preferably 0.1 parts by mass to 20 parts by mass, and is more preferably 0.5 parts by mass to 10 parts by mass, with respect to 100 parts by mass of the polymerizable compound. According to the range described above, the occurrence frequency of the passing through of the toner further decreases, and the lifetime of the organic photoreceptor and the electrophotographic image forming apparatus is further improved.

(Other Components)

Other components may be contained in the protective layer, and for example, an antioxidant, lubricant particles, and the like can be contained in the protective layer.

The antioxidant is not particularly limited, and for example, an antioxidant described in Japanese Patent Application Laid-Open No. 2000-305291, can be preferably used as the antioxidant.

The lubricant particles are not particularly limited, and for example, fluorine atom-containing resin particles can be added as the lubricant particles. The fluorine atom-containing resin particles are not particularly limited, and examples of the fluorine atom-containing resin particles include a tetrafluoroethylene resin, a trifluorochloroethylene resin, a hexafluorochloroethylene propylene resin, a vinyl fluoride resin, a vinylidene fluoride resin, an ethylene difluoride dichloride resin, a copolymer thereof, and the like. Only one type of fluorine atom-containing resin particles can be independently used, or two or more types thereof can be used by being mixed. Among them, the tetrafluoroethylene resin and the fluoride vinylidene resin are particularly preferable.

[Conductive Support Body]

The conductive support body configuring the organic photoreceptor is not particularly limited insofar as having conductivity, and examples of the conductive support body include a conductive support body obtained by molding a metal such as aluminum, copper, chromium, nickel, zinc, and stainless steel, into the shape of a drum or a sheet, a conductive support body obtained by laminating a metal foil of aluminum, copper, or the like, on a plastic film, a conductive support body obtained by vapor-depositing aluminum, indium oxide, tin oxide, and the like, on a plastic film, a metal, a plastic film, and paper in which a conductive layer is provided by applying a conductive substance independently or along with a binder resin, and the like.

[Interlayer]

In the organic photoreceptor, the interlayer having a barrier function and an adhesion function, can be disposed between the conductive support body and the organic photosensitive layer. In consideration of preventing various failures, or the like, it is preferable that the interlayer is provided.

The interlayer, for example, contains the binder resin (hereinafter, also referred to as a "binder resin for an interlayer"), and as necessary, conductive particles or metal oxide particles.

The binder resin for an interlayer is not particularly limited, and examples of the binder resin for an interlayer include casein, polyvinyl alcohol, nitrocellulose, an ethylene-acrylate copolymer, a polyamide resin, a polyurethane resin, gelatin, and the like. Among them, an alcohol-soluble polyamide resin is preferable. Only one type of binder resins for an interlayer may be independently used, or two or more types thereof may be used by being mixed.

In the interlayer, various conductive particles or metal oxide particles can be contained in order to adjust resistance. For example, various metal oxide particles such as alumina, zinc oxide, titanium oxide, tin oxide, antimony oxide, indium oxide, and bismuth oxide, can be used. In addition, ultrafine particles of indium oxide doped with tin, tin oxide doped with antimony, zirconium oxide, and the like, can be used.

A number average primary particle diameter of the metal oxide particles is preferably less than or equal to 0.3 μm, and is more preferably less than or equal to 0.1 μm.

Only one type of metal oxide particles may be independently used, or two or more types thereof may be used by being mixed. In a case of mixing two or more types of metal oxide particles, the metal oxide particles may be in the form of a solid solution or being fused.

A content ratio of the conductive particles or the metal oxide particles is preferably 20 parts by mass to 400 parts by mass, and is more preferably 50 parts by mass to 350 parts by mass, with respect to 100 parts by mass of the binder resin.

A layer thickness of the interlayer is preferably 0.1 μm to 15 μm, and is more preferably 0.3 μm to 10 μm.

[Charge Generating Layer]

The charge generating layer in the organic photosensitive layer configuring the organic photoreceptor, contains a charge generating substance and a binder resin (hereinafter, also referred to as a "binder resin for a charge generating layer").

Examples of the charge generating substance include an azo pigment such as Sudan Red and Diane Blue, a quinone pigment such as pyrene quinone and anthanthrone, a quinocyanine pigment, a perylene pigment, an indigo pigment such as indigo and thioindigo, a polycyclic quinone pigment such as pyranthron and diphthaloyl pyrene, a phthalocyanine pigment, and the like, but the charge generating substance is not limited thereto. Among them, the polycyclic quinone pigment and a titanyl phthalocyanine pigment are preferable. Only one type of charge generating substances may be independently use, or two or more types thereof may be used by being mixed.

A known resin can be used as the binder resin for a charge generating layer, and examples of the charge generating layer include a polystyrene resin, a polyethylene resin, a polypropylene resin, an acrylic resin, a methacrylic resin, a vinyl chloride resin, a vinyl acetate resin, a polyvinyl butyral resin, an epoxy resin, a polyurethane resin, a phenolic resin, a polyester resin, an alkyd resin, a polycarbonate resin, a silicone resin, a melamine resin, a copolymer resin containing two or more resins described above (for example, a vinyl chloride-vinyl acetate copolymer resin and a vinyl chloride-vinyl acetate-maleic anhydride copolymer resin), a polyvinyl carbazole resin, and the like, but the charge generating layer is not limited thereto. Among them, the polyvinyl butyral resin is preferable. Only one type of binder resins for a charge generating layer may be independently used, or two or more types thereof may be used by being mixed.

A content ratio of the charge generating substance in the charge generating layer, is preferably 1 part by mass to 600 parts by mass, and is more preferably 50 parts by mass to 500 parts by mass, with respect to 100 parts by mass of the binder resin for a charge generating layer.

A layer thickness of the charge generating layer is different according to the properties of the charge generating substance, the properties of the binder resin for a charge generating layer, the content ratio, or the like, and is preferably 0.01 μm to 5 μm, and is more preferably 0.05 μm to 3 μm.

[Charge Transfer Layer]

The charge transfer layer in the organic photosensitive layer configuring the organic photoreceptor, contains a charge transfer substance and a binder resin (hereinafter, also referred to as a "binder resin for a charge transfer layer").

A substance transferring a charge (a hole), is used as the charge transfer substance of the charge transfer layer, and examples of the charge transfer substance include a triphenyl amine derivative, a hydrazone compound, a styryl compound, a benzidine compound, a butadiene compound, and the like.

It is preferable that the charge transfer layer to be formed on the underlayer of the protective layer, contains a charge transfer substance having a high mobility and a large molecular weight, and a compound different from the compound represented by General Formula (1) described above, is preferably used as the charge transfer substance.

A known resin can be used as the binder resin for a charge transfer layer, examples of the binder resin for a charge transfer layer include a polycarbonate resin, a polyacrylate resin, a polyester resin, a polystyrene resin, a styrene-acrylnitrile copolymer resin, a polymethacrylic acid ester resin, a styrene-methacrylic acid ester copolymer resin, and the like, and the polycarbonate resin is preferable. Further, a bisphenol A (BPA) type polycarbonate resin, a bisphenol Z (BPZ) type polycarbonate resin, a dimethyl BPA type polycarbonate resin, a BPA-dimethyl BPA copolymer type polycarbonate resin, and the like are preferable from the viewpoint of crack resistance, wear resistance, and charging properties. Only one type of binder resins for a charge transfer layer may be independently used, or two or more types thereof may be used by being mixed.

A content ratio of the charge transfer substance in the charge transfer layer, is preferably 10 parts by mass to 500 parts by mass, and is more preferably 20 parts by mass to 250 parts by mass, with respect to 100 parts by mass of the binder resin for a charge transfer layer.

A layer thickness of the charge transfer layer is different according to the properties of the charge transfer substance, the properties of the binder resin for a charge transfer layer, the content ratio, or the like, and is preferably 5 μm to 40 μm, and is more preferably 10 μm to 30 μm.

An antioxidant, an electroconductive agent, a stabilizer, silicone oil, and the like may be added to the charge transfer layer. A antioxidant disclosed in Japanese Patent Application Laid-Open No. 2000-305291, is preferable as the antioxidant, and an electroconductive agent disclosed in Japanese Patent Application Laid-Open No. 50-137543, Japanese Patent Application Laid-Open No. 58-76483, and the like is preferable as the electroconductive agent.

[Manufacturing Method of Organic Photoreceptor]

A manufacturing method of the organic photoreceptor is not particularly limited, but it is preferable that the organic photoreceptor is manufactured by a manufacturing method including the following steps.

Step (1): A step of forming the interlayer by applying a coating liquid for forming an interlayer onto an outer circumferential surface of the conductive support body, and by drying the coating liquid, as necessary, Step (2): A step of forming the charge generating layer by applying a coating liquid for forming a charge generating layer onto the outer circumferential surface of the conductive support body or an outer circumferential surface of the interlayer formed on the conductive support body in Step (1), and by drying the coating liquid, Step (3): A step of forming the charge transfer layer by applying coating liquid for forming a charge transfer layer onto an outer circumferential surface of the charge generating layer formed on the interlayer, and by drying the coating liquid, and Step (4): A step of forming the protective layer by applying a coating liquid for forming a protective layer onto an outer circumferential surface of the charge transfer layer formed on the charge generating layer, by polymerizing and curing the coating liquid, as necessary.

The concentration of each of the components in the coating liquids for forming each of the layers, is suitably selected according to a layer thickness or a production rate of each of the layers.

In the coating liquids for forming each of the layers, an ultrasonic disperser, a ball mill, a sand mill, a homomixer, and the like, can be used as a dispersion means of particles such as conductive particles or metal oxide particles, the charge generating substance, or the like, but the dispersion means is not limited thereto.

A coating method of the coating liquids for forming each of the layers, is not particularly limited, and examples of the coating method include a known method such as an immersion coating method, a spray coating method, a spinner coating method, a bead coating method, a blade coating method, a beam coating method, a slide hopper method, and a circular slide hopper method.

A drying method of a coated film can be suitably selected according to the type of solvent, and a layer thickness, and thermal drying is preferable.

Hereinafter, the details of forming steps of each of the layers, will be described.

(Step (1): Formation of Interlayer)

A coating liquid (hereinafter, also referred to as the "coating liquid for forming an interlayer") is prepared by dissolving the binder resin for an interlayer in a solvent, and as necessary, conductive particles or metal oxide particles are dispersed, and then, a coated film is formed by applying the coating liquid onto the conductive support body with a constant layer thickness, and the coated film is dried, and thus, the interlayer can be formed.

It is preferable that the coating liquid for forming an interlayer is applied by using an immersion coating method.

A solvent in which the conductive particles or the metal oxide particles are excellently dispersed, and the binder resin for an interlayer, in particular, a polyamide resin is dissolved, is preferable as the solvent used in the forming step of the interlayer. Specifically, alcohols having 1 to 4 carbon atoms, such as methanol, ethanol, n-propyl alcohol, isopropyl alcohol, n-butanol, tert-butanol, and sec-butanol (2-butanol), are excellent in solubility and coating performance of the polyamide resin, and thus, are preferable. In addition, examples of an auxiliary solvent which can be used along with the solvent in order to improve preserving properties and dispersion properties of particles, and is capable of obtaining a preferred effect include benzyl alcohol, toluene, dichloromethane, cyclohexanone, tetrahydrofuran, and the like.

(Step (2): Formation of Charge Generating Layer)

A coating liquid (hereinafter, also referred as the "coating liquid for forming a charge generating layer") is prepared by dispersing the charge generating substance in a solution in which the binder resin for a charge generating layer is dissolved in a solvent, a coated film is formed by applying the coating liquid onto the interlayer with a constant layer thickness, and the coated film is dried, and thus, the charge generating layer can be formed.

It is preferable that the coating liquid for forming a charge generating layer is applied by using an immersion coating method.

Examples of the solvent used for forming the charge generating layer include toluene, xylene, dichloromethane, 1,2-dichloroethane, methyl ethyl ketone, cyclohexane, ethyl acetate, tert-butyl acetate, methanol, ethanol, n-propyl alcohol, isopropyl alcohol, n-butanol, tert-butanol, sec-butanol (2-butanol), methyl cellosolve, 4-methoxy-4-methyl-2-pentanone, ethyl cellosolve, tetrahydrofuran, 1,4-dioxane, 1,3-dioxolane, pyridine, diethyl amine, and the like, but the solvent is not limited thereto.

(Step (3): Formation of Charge Transfer Layer)

A coating liquid (hereinafter, also referred to as the "coating liquid for forming a charge transfer layer") is prepared, in which the binder resin for a charge transfer layer, the charge transfer substance, and the like are dissolved in a solvent, a coated film is formed by applying the coating liquid onto the charge generating layer with a constant layer thickness, and the coated film is dried, and thus, the charge transfer layer can be formed.

It is preferable that the coating liquid for forming a charge generating layer is applied by a slide hopper method using a circular slide hopper coating device, and for example, the coating liquid for forming a charge generating layer can be applied by a method disclosed in Japanese Patent Application Laid-Open No. 2015-114454, and the like.

Examples of the solvent used for forming the charge transfer layer include toluene, xylene, dichloromethane, 1,2-dichloroethane, methyl ethyl ketone, cyclohexanone, ethyl acetate, butyl acetate, methanol, ethanol, n-propyl alcohol, isopropyl alcohol, n-butanol, tert-butanol, sec-butanol (2-butanol), tetrahydrofuran, 1,4-dioxane, 1,3-dioxolane, pyridine, diethyl amine, and the like, but the solvent is not limited thereto.

(Step (4): Formation of Protective Layer)

A coating liquid (hereinafter, also referred to as the "coating liquid for forming a protective layer") is prepared by adding a polymerizable compound, and as necessary, other components such as metal oxide particles, a polymerization initiator, a specific radical scavenger, and a charge transfer substance, to a known solvent, a coated film is formed by applying the coating liquid for forming a protective layer onto the outer circumferential surface of the charge transfer layer formed in Step (3), the coated film is dried, and is irradiated with an active ray such as an ultraviolet ray or an electron ray, and a polymerizable compound component in the coated film is polymerized and cured, and thus, the protective layer can be formed.

It is preferable that the protective layer is formed such that the universal hardness of the organic photoreceptor is within a desired range by suitably controlling the type or the content of the polymerizable compound, and the oxide particles, the polymerization initiator, the specific radical scavenger, the charge transfer substance, and the like to be added as necessary, the condition of the polymerization reaction, and the like.

It is preferable that the coating liquid for forming a protective layer is applied by a slide hopper method using a circular slide hopper coating device, and for example, the coating liquid for forming a protective layer can be applied by a method disclosed in Japanese Patent Application Laid-Open No. 2015-114454, and the like.

Any solvent can be used as the solvent used for forming the protective layer insofar as dissolving or dispersing the polymerizable compound, the metal oxide particles, and the like, and examples of the solvent include methanol, ethanol, n-propyl alcohol, isopropyl alcohol, n-butanol, tert-butanol, sec-butanol (2-butanol), benzyl alcohol, toluene, xylene, dichloromethane, methyl ethyl ketone, cyclohexane, ethyl acetate, butyl acetate, methyl cellosolve, ethyl cellosolve, tetrahydrofuran, 1,4-dioxane, 1,3-dioxolane, pyridine, diethyl amine, and the like, but the solvent is not limited thereto.

A method of reacting the polymerizable compound, is not particularly limited, and examples of the method include a method of reacting the polymerizable compound with an electron ray cleavage, a method of adding a radical polymerization initiator, and of reacting the polymerizable compound with light and heat, and the like.

The coated film is irradiated with the active ray, is polymerized by generating a radical, and is cured by forming a cross-linking bond according to a cross-linking reaction between molecules and in molecules, as a curing treatment, and thus, the cured resin component is generated. The ultraviolet ray or the electron ray is more preferably, and the ultraviolet ray is easily used, and thus, is particularly preferably, as the active ray.

Any light source can be used as an ultraviolet ray light source, without any limitation, insofar as generating an ultraviolet ray. For example, a low-pressure mercury lamp, an intermediate-pressure mercury lamp, a high-pressure mercury lamp, an ultrahigh-pressure mercury lamp, a carbon arc lamp, a metal halide lamp, a xenon lamp, flash (pulse) xenon, and the like can be used as the ultraviolet ray light source.

An irradiation condition is different according to each of the lamps, and irradiation dose of the active ray is preferably 5 $mJ/cm^2$ to 500 $mJ/cm^2$, and is more preferably 5 $mJ/cm^2$ to 100 $mJ/cm^2$.

The power of the lamp is preferably 0.1 kW to 5 kW, is more preferably 0.5 kW to 4 kW, and is even more preferably 0.5 kW to 3 kW.

An irradiation time for obtaining necessary irradiation dose of the active ray, is preferably 0.1 seconds to 10 minutes, and is more preferably 0.1 seconds to 5 minutes, from the viewpoint of a working efficiency.

In the forming step of the protective layer, the drying can be performed before and after the irradiation of the active ray, and during the irradiation of the active ray, and a timing of performing the drying can be suitably selected according to a combining thereof.

<Electrophotographic Image Forming Apparatus>

The tandem type electrophotographic image forming apparatus according to one embodiment of the invention is a tandem type electrophotographic image forming apparatus using an organic photoreceptor in which at least a charge generating layer and a charge transfer layer are sequentially laminated on a conductive support body, the apparatus including at least: a plurality of image forming units including an electrostatic latent image forming means forming an electrostatic latent image on the organic photoreceptor, a developing means forming a toner image by supplying a toner to the organic photoreceptor, and by developing the electrostatic latent image, a lubricant supplying means supplying a lubricant to a front surface of the organic photoreceptor, and a cleaning means removing the toner remaining on the front surface of the organic photoreceptor with a cleaning blade.

Here, the electrophotographic image forming apparatus further includes a charging means charging the front surface of the organic photoreceptor, and it is preferable that the electrostatic latent image forming means described above is an exposure means forming the electrostatic latent image by exposing the organic photoreceptor charged by the charging means. In addition, it is preferable that the electrophotographic image forming apparatus further includes a transfer means transferring the toner image formed on the organic photoreceptor. That is, it is particularly preferable that the tandem type electrophotographic image forming apparatus according to one embodiment of the invention includes at least the charging means, the exposure means (the electrostatic latent image forming means), the developing means, the transfer means, the lubricant supplying means, and the cleaning means, described above.

[Disposition of Image Forming Unit and Organic Photoreceptor]

The tandem type electrophotographic image forming apparatus according to one embodiment of the invention includes two or more image forming units including toners having colors different from each other, it is preferable that the tandem type electrophotographic image forming apparatus includes three or more image forming units including toners, and it is more preferable that the tandem type electrophotographic image forming apparatus includes four or more image forming units including toners. In addition, it is preferable that the number of image forming units including the toners having colors different from each other, is less than or equal to 8. Among them, it is particularly preferable that the tandem type electrophotographic image forming apparatus includes four image forming units including the toners having colors different from each other. Accordingly, the tandem type electrophotographic image forming apparatus according to one embodiment of the invention includes one or more combinations of two adjacent image forming units including the toners having colors different from each other, it is preferable that the tandem type electrophotographic image forming apparatus includes two or more combinations, and it is more preferable that the tandem type electrophotographic image forming apparatus includes three or more combinations. In addition, it is preferable that the number of combinations of the two adjacent image forming units including the toners having colors different from each other, is less than or equal to 7. Among them, it is particularly preferable that the tandem type electrophotographic image forming apparatus includes three combinations of the two adjacent image forming units including the toners having colors different from each other. According to the range described above, the effects of the invention are further exhibited.

In the tandem type electrophotographic image forming apparatus according to one embodiment of the invention, when the linear pressure of the cleaning blade A included in the image forming unit disposed on the upstream side, is set to P1, and the linear pressure of the cleaning blade B included in the image forming unit disposed on the downstream side, is set to P2, at least one of the combinations of the two adjacent image forming units including the toners having colors different from each other, satisfies Equation (1) described below.

[Expression 3]

$$P2>P1 \quad (1)$$

In all of the combinations of the two adjacent image forming units including the toners having colors different from each other, in a case where P2 is less than or equal to P1, and the linear pressure of the cleaning blade is high, in the organic photoreceptor disposed on the upstream side, deterioration due to the wear of the cleaning blade becomes remarkable, and thus, the passing through of the toner occurs. In addition, in the organic photoreceptor disposed on the downstream side, a load is excessively applied to the front surface of the organic photoreceptor and the cleaning blade, and the lifetime of the organic photoreceptor is shortened. Such a tendency becomes remarkable when P2 is less than P1. In a case where the linear pressure of the cleaning blade is low, in the organic photoreceptor disposed on the downstream side, the amount of reverse transfer toner increases, and thus, the passing through of the toner occurs. In order to suppress the occurrence of such problems, in at least one of the combinations of the two adjacent image forming units including the toners having colors different from each other, as represented by Equation (1), P2 is required to be greater than P1.

In addition, in at least one of the combinations of the two adjacent image forming units, it is preferable that the linear pressure P1 of the cleaning blade A included in the image forming unit disposed on the upstream side, and the linear pressure P2 of the cleaning blade B included in the image forming unit disposed on the downstream side, satisfy Equation (2) described below.

[Expression 4]

$$P2-P1\geq 2\ \text{N/m} \quad (2)$$

Here, a difference obtained by subtracting P1 from P2, is more preferably greater than or equal to 3 N/m, and is even more preferably greater than or equal to 4 N/m. In addition, the difference obtained by subtracting P1 from P2, is preferably less than or equal to 20 N/m, and is more preferably less than or equal to 10 N/m. According to the range described above, the occurrence frequency of the passing through of the toner further decreases, and the lifetime of the organic photoreceptor and the electrophotographic image forming apparatus is further improved.

In addition, in the tandem type electrophotographic image forming apparatus according to one embodiment of the invention, three of more image forming units include the electrostatic latent image forming means, the developing means, the lubricant supplying means, and the cleaning means, it is preferable that at least two of the combinations of the two adjacent image forming units including the toners having colors different from each other, satisfy Equation (1) described above, it is more preferable that at least three of the combinations satisfy Equation (1) described above, and it is even more preferable that all of the combinations satisfy Equation (1) described above. According to the range described above, the occurrence frequency of the passing through of the toner further decreases, organic photoreceptor, and the lifetime of the organic photoreceptor and the electrophotographic image forming apparatus is further improved.

In the tandem type electrophotographic image forming apparatus according to one embodiment of the invention, it is preferable that in the combinations of the two adjacent image forming units including the toners having colors different from each other, all of the combinations not satisfying Equation (1) described above, satisfy Equation (3) described below.

[Expression 5]

$$P2=P1 \quad (3)$$

In addition, in the tandem type electrophotographic image forming apparatus according to one embodiment of the invention, it is preferable that a linear pressure Pmu of a cleaning blade MU included in an image forming unit disposed on the most upstream side, and a linear pressure Pmd of a cleaning blade MD included in an image forming unit disposed on the most downstream side, satisfy Equation (5) described below.

[Expression 6]

$$Pmd-Pmu \geq 1 \text{ N/m} \quad (5)$$

A difference obtained by subtracting Pmu from Pmd, represented by Equation (5) described above, is more preferably 1 N/m to 20 N/m, is even more preferably 2 N/m to 10 N/m, is particularly preferably 3 N/m to 10 N/m, and is most preferably 4 N/m to 9 N/m. According to the range described above, the occurrence frequency of the passing through of the toner further decreases, and the lifetime of the organic photoreceptor and the electrophotographic image forming apparatus is further improved.

The linear pressure can be measured by using a load converter converting a load into a voltage value. For example, a strain gage type load converter "9E01-L43-10N" (manufactured by Nippon Avionics Co., Ltd.) is included as an example of the load converter. Furthermore, the details of a measurement method and a calculation method of the linear pressure will be described in the examples.

The control method of the linear pressure of the cleaning blade is not particularly limited, and for example, the linear pressure can be controlled by adjusting the deflection of the cleaning blade according to the disposition of a retaining member retaining the cleaning blade.

In the tandem type electrophotographic image forming apparatus according to one embodiment of the invention, when the universal hardness of the organic photoreceptor C included in the image forming unit disposed on the upstream side, is set to He, and the universal hardness of the organic photoreceptor D included in the image forming unit disposed on the downstream side, is set to Hd, it is preferable that at least one of the combinations of the two adjacent image forming units including the toners having colors different from each other, satisfies Equation (4) described below.

[Expression 7]

$$Hd-Hc \geq 10 \text{ N/mm}^2 \quad (4)$$

In addition, in at least one of the combinations of the two adjacent image forming units, a difference obtained by subtracting He from Hd, is preferably 10 N/mm$^2$ to 140 N/mm$^2$, is more preferably 10 N/mm$^2$ to 70 N/mm$^2$, is even more preferably 10 N/mm$^2$ to 40 N/mm$^2$, is particularly preferably 20 N/mm$^2$ to 40 N/mm$^2$, and is most preferably 30 N/mm$^2$ to 40 N/mm$^2$. According to the range described above, the occurrence frequency of the passing through of the toner further decreases, and the lifetime of the organic photoreceptor and the electrophotographic image forming apparatus is further improved.

In addition, in the tandem type electrophotographic image forming apparatus according to one embodiment of the invention, three or more image forming units include the electrostatic latent image forming means, the developing means, the lubricant supplying means, and the cleaning means, it is preferable that at least two of the combinations of the two adjacent image forming units including the toners having colors different from each other, satisfy Equation (4) described above, it is more preferable that at least three of the combinations satisfy Equation (4) described above, and it is even more preferable that all of the combinations satisfy Equation (4) described above. According to the range described above, the occurrence frequency of the passing through of the toner further decreases, and the lifetime of the organic photoreceptor and the electrophotographic image forming apparatus is further improved.

Furthermore, in the tandem type electrophotographic image forming apparatus according to one embodiment of the invention, the combination of the image forming unit including the cleaning blade A and the image forming unit including the cleaning blade B, satisfying Equation (1) described above, may be identical to or different from the combination of the image forming unit including the organic photoreceptor C and the image forming unit including the organic photoreceptor D, satisfying Equation (4) described above and it is preferable that the combinations are identical to each other. In a case where the combinations are identical to each other, a relationship in different amounts of reverse transfer toner in the disposition of each of the organic photoreceptors of the tandem type electrophotographic image forming apparatus, different amounts of lubricant capable of existing on each of the organic photoreceptors, and the linear pressure of the cleaning blade included in each of the image forming units, and a relationship between the hardness of the front surface of the organic photoreceptor, and the amounts described above, can also be optimized. At this time, the effects of the invention, in particular, the lifetime of the organic photoreceptor and the electrophotographic image forming apparatus is extremely remarkably improved.

In the tandem type electrophotographic image forming apparatus according to one embodiment of the invention, in the combinations of the two adjacent image forming units including the toners having colors different from each other, in a case where there is a combination not satisfying Equation (4) described above, it is preferable that all of the combinations not satisfying Equation (4) described above satisfy Equation (6) described below.

[Expression 8]

$$Hd \geq Hc \quad (6)$$

In the tandem type electrophotographic image forming apparatus according to one embodiment of the invention, it is preferable that at least one of the organic photoreceptors D is for a black color. In addition, it is preferable that at least one of the organic photoreceptors C is for a chromatic color. This is because the organic photoreceptor for a black color, which is a darker color, is disposed on the downstream side, and thus, the dark color is provided on the inside in a formed image, and it is possible to improve image quality. In addition, this is because a reverse transfer toner to be reversely transferred to the organic photoreceptor for a black color, which is a darker color, is a lighter color, and thus, it is possible to decrease the influence of the reverse transfer toner on the image quality.

In addition, in the tandem type electrophotographic image forming apparatus according to one embodiment of the invention, it is preferable that a universal hardness Hmu of an organic photoreceptor MU included in the image forming unit disposed on the most upstream side, and a universal hardness Hmd of an organic photoreceptor MD included in the image forming unit disposed on the most downstream side, satisfy Equation (7) described below.

[Expression 9]

$$Hmd-Hmu \geq 10\ \mathrm{N/mm^2} \quad (7)$$

From the same viewpoint, a difference obtained by subtracting Hmu from Hmd, represented by Equation (7) described above, is preferably 10 $N/mm^2$ to 140 $N/mm^2$, is more preferably 10 $N/mm^2$ to 120 $N/mm^2$, is even more preferably 30 $N/mm^2$ to 120 $N/mm^2$, is particularly preferably 30 $N/mm^2$ to 100 $N/mm^2$, and is most preferably 50 $N/mm^2$ to 100 $N/mm^2$. According to the range described above, the occurrence frequency of the passing through of the toner further decreases, and the lifetime of the organic photoreceptor and the electrophotographic image forming apparatus is further improved.

Furthermore, herein, toners having different colors indicate that expression colors such as a yellow color, a magenta color, a cyan color, and a black color, are different from each other, and toners having the same color do not include a difference in gray scale colors having different concentrations.

[Configuration of Electrophotographic Image Forming Apparatus]

Hereinafter, the tandem type electrophotographic image forming apparatus according to one embodiment of the invention will be described with reference to the attached drawings. Here, the invention is not limited to one embodiment described below.

Figure 2:
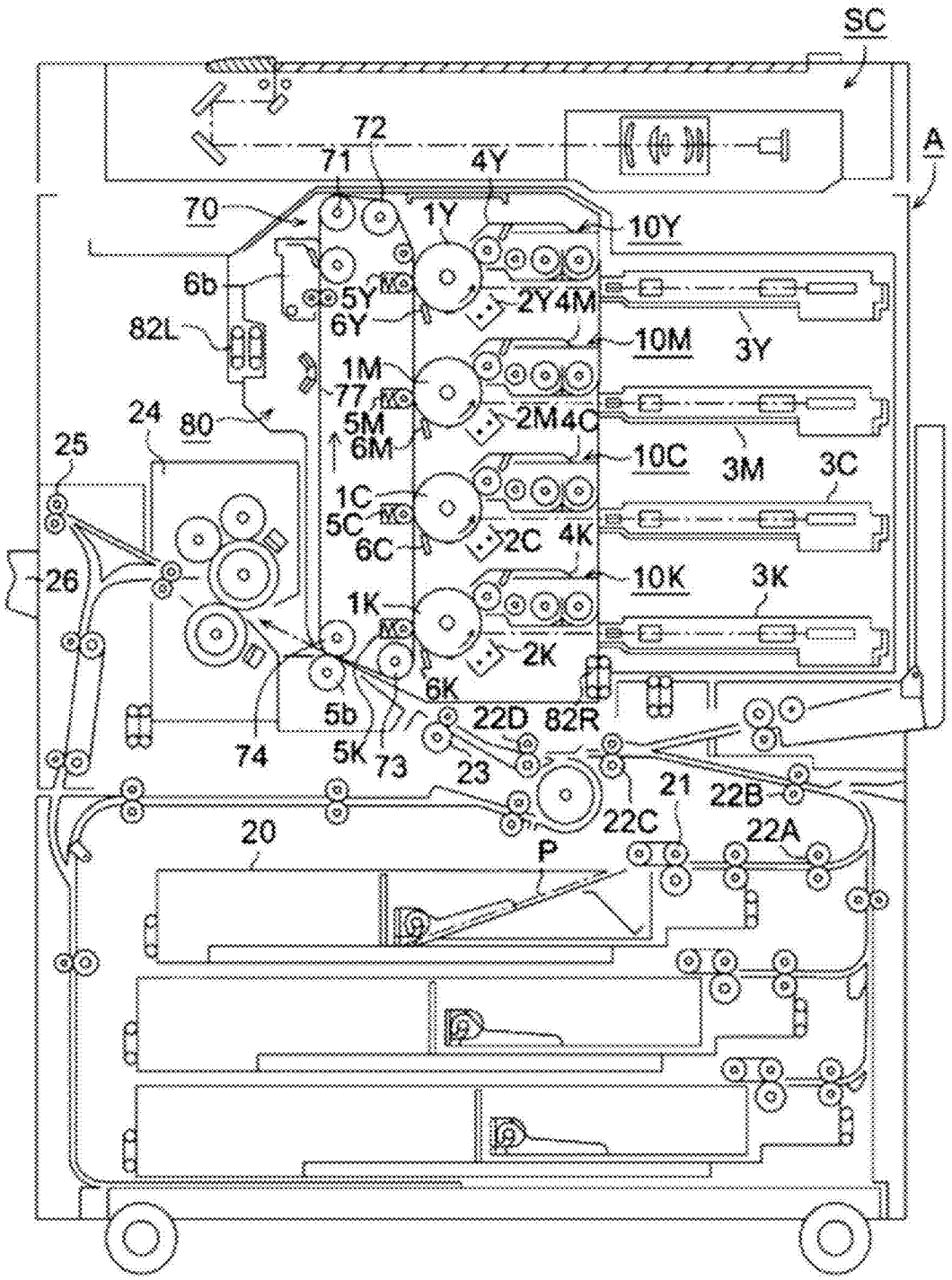
FIG. 2 is a meansal schematic view illustrating a structure of the tandem type electrophotographic image forming apparatus according to one embodiment of the invention.
Figure 3:
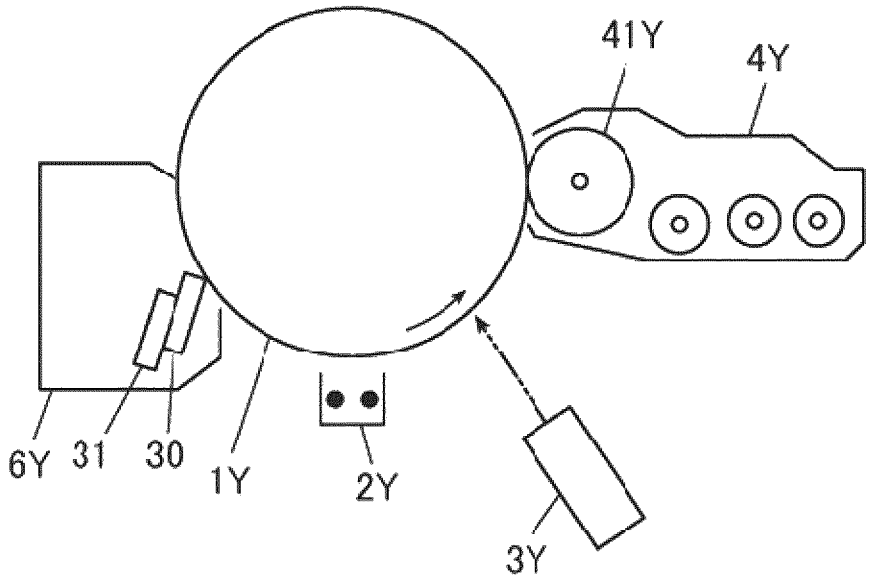
FIG. 3 is an enlarged schematic view illustrating a disposition relationship between the organic photoreceptor and a cleaning blade, in the tandem type electrophotographic image forming apparatus according to one embodiment of the invention.

FIG. 2 is a meansal schematic view illustrating the structure of the tandem type electrophotographic image forming apparatus according to one embodiment of the invention, and FIG. 3 is an enlarged schematic view illustrating a disposition relationship between the organic photoreceptor and the cleaning blade, in the tandem type electrophotographic image forming apparatus according to one embodiment of the invention.

The electrophotographic image forming apparatus is referred to as a tandem type color image forming apparatus, and includes four sets of image forming parts (the image forming units) 10Y, 10M, 10C, and 10K, an intermediate transfer body unit 70, a paper feeding means 21, and a fixing means 24. An original image reading device SC is disposed on a main body A of the electrophotographic image forming apparatus.

The four image forming units 10Y, 10M, 10C, and 10K mainly include photoreceptors 1Y, 1M, 1C, and 1K, and include charging means 2Y, 2M, 2C, and 2K, exposure means 3Y, 3M, 3C, and 3K, rotating developing means 4Y, 4M, 4C, and 4K, primary transfer rollers 5Y, 5M, 5C, and 5K as a primary transfer means, and cleaning means 6Y, 6M, 6C, and 6K cleaning the photoreceptors 1Y, 1M, 1C, and 1K.

Furthermore, in the tandem type electrophotographic image forming apparatus according to one embodiment of the invention, each of the organic photoreceptors described above is used as the photoreceptors 1Y, 1M, 1C, and 1K.

The image forming units 10Y, 10M, 10C, and 10K have the same configuration except that the colors of the toners are different from each other, such as a yellow (Y) color, a magenta (M) color, a cyan (C) color, and a black (K) color. Accordingly, hereinafter, the image forming unit 10Y will be described in detail, as an example.

The image forming unit 10Y includes the charging means 2Y, the exposure means 3Y, the developing means 4Y, and the cleaning means 6Y, around the photoreceptor 1Y, which is an image forming body, and forms a yellow (Y) toner image on the photoreceptor 1Y.

The charging means 2Y is a means evenly charging a front surface of the photoreceptor 1Y to a negative polarity. For example, a corona discharge type charger is used as the charging means 2Y.

The exposure means 3Y is a means forming an electrostatic latent image corresponding to the yellow image by exposing the photoreceptor 1Y to which an even potential is applied by the charging means 2Y, on the basis of an image signal (yellow). An exposure means including an LED in which light emitting elements are arranged into the shape of an array, in an axial direction of the photoreceptor 1Y, and an image forming element, a laser optical system, or the like, is used as the exposure means 3Y.

The developing means 4Y, for example, includes a developing sleeve 41Y which includes a magnet therein, retains a developer, and rotates, and a voltage applying device applying a direct current bias voltage and/or an alternate current bias voltage between the photoreceptor 1Y and the developing sleeve 41Y.

The developing means 4Y contains a developer of a Y component (for example, a two-component developer containing a toner and a magnetic carrier as a main component). The developing means 4Y forms the toner image by attaching a toner of the Y component onto the front surface of the photoreceptor 1Y, and by visualizing the electrostatic latent image. Specifically, a developing bias is applied to the developing sleeve 41Y, and a developing electrical field is formed between the photoreceptor 1Y and the developing sleeve 41Y. The charged toner (a negative polarity) on the developing sleeve 41Y is moved and attached to the exposure unit of the front surface of the photoreceptor 1Y, according to a potential difference between the photoreceptor 1Y (a negative polarity) and the developing sleeve 41Y. That is, the developing means 4Y develops the electrostatic latent image according to a reverse development method.

The cleaning means 6Y is a means removing the toner remaining on the front surface of the photoreceptor 1Y. The cleaning means 6Y of this embodiment includes a cleaning blade. The cleaning blade includes a support member 31, and a blade member 30 supported on the support member 31 through an adhesive layer (not illustrated). The blade member 30 is disposed in a state where a tip end thereof is directed towards an opposite direction (a counter direction) to a rotation direction of the photoreceptor 1Y, in an abutting portion with respect to the front surface of the photoreceptor 1Y.

The support member 31 is not particularly limited, a known support member of the related art can also be used, and examples of the support member include a support member manufactured by a rigid metal, an elastic metal, plastic, ceramic, and the like. Among them, the rigid metal is preferable.

The blade member 30 is not particularly limited, and for example, polyurethane, silicon rubber, fluorine rubber, chloropyrene rubber, butadiene rubber, and the like can be used as the blade member 30. Among them, the polyurethane is preferable from the viewpoint of obtaining proper strength and flexibility of enabling the blade member 30 to abut on the rotating photoreceptor 1Y. The blade member 30 using the polyurethane, for example, can be manufactured by adding a cross-linking agent to a prepolymer which is obtained by mixing polyol and an isocyanate compound, subjected to a dehydration treatment, and by performing a reaction in a temperature range of 100° C. to 120° C. for 30 minutes to 90 minutes, by injecting the mixture into a metal mold, and by curing the mixture. For example, polyester polyol such as polyethylene adipate and polycaprolactone, and the like can be used as the polyol, and diphenyl methane diisocyanate and the like can be used as the isocyanate compound. In addition, 1,4-butanediol, trimethylol propane, ethylene glycol, and a mixture thereof, can be used as the cross-linking agent.

The blade member 30 may include a cured layer in a portion abutting on the photoreceptor 1Y. The hardness of the main body of the blade member is easily adjusted such that flexibility of allowing the blade member 30 to be properly bent at the time of abutting on the photoreceptor 1Y can be obtained, by including the cured layer in the abutting portion. The cured layer may be a layer disposed on a front surface of the blade member 30, and a layer in which a part of the main body of the blade member 30 is subjected to a processing treatment, is preferable from the viewpoint of increasing durability.

In a case where polyurethane is used as a base material of the blade member 30, the abutting portion of the blade member 30 with respect to the photoreceptor 1Y is impregnated in an isocyanate compound for a certain period of time, and the polyurethane contained in the main body of the blade member 30 reacts with the isocyanate compound, and thus, a reaction portion thereof can be formed as the cured layer. The cured layer formed as described above contains a polymer of the polyurethane and the isocyanate compound. There is a urethane bond having active hydrogen in the polyurethane configuring the blade member 30, and the urethane bond reacts with the impregnated isocyanate compound, and thus, an allophanate bond of increasing the hardness of the cured layer, can be formed between the polyurethane contained in the blade member 30, and the polymer contained in the cured layer. In addition, a polymerization reaction of the impregnated isocyanate compound also simultaneously progresses, and thus, it is possible to form a thick cured layer, and even in a case where the cured layer is worn, it is possible to maintain excellent hardness of the blade member 30 for a long period of time, since the cured layer is thick.

A linear pressure of the blade member 30 abutting on the photoreceptor 1Y (the linear pressure of the cleaning blade) is not particularly limited, and is preferably 15 N/m to 35 N/m, is more preferably 20 N/m to 35 N/m, and is even more preferably 22 N/m to 31 N/m. According to the range described above, a scraping force of the remaining toner increases, and higher cleaning performance is realized. In addition, an inclination angle θ of the blade member 30 with respect to the front surface of the photoreceptor 1Y is not particularly limited, and is preferably 5° to 20°. According to the range described above, the scraping force of the remaining toner increases, and higher cleaning performance is realized.

In the image forming unit 10Y of the electrophotographic image forming apparatus illustrated in FIG. 2, the photoreceptor 1Y, the charging means 2Y, the developing means 4Y, a lubricant supplying means described below (not illustrated), and the cleaning means 6Y are integrally supported, and are provided as a process cartridge, and the process cartridge may be detachable to the main body A of the device through a guide means such as a rail.

The image forming units 10Y, 10M, 10C, and 10K are vertically disposed in a perpendicular direction, and the intermediate transfer body unit 70 is disposed on the left side of the photoreceptors 1Y, 1M, 1C, and 1K in the drawing. The intermediate transfer body unit 70 is wound by a plurality of rollers 71, 72, 73, and 74, and includes a rotatably supported semiconductive endless belt-like intermediate transfer body 77, a secondary transfer roller 5*b* as the secondary transfer means, and a cleaning means 6*b*.

The image forming units 10Y, 10M, 10C, and 10K, and the intermediate transfer body unit 70 are contained in a housing 80, and the housing 80 can be withdrawn from the main body A of the device through support rails 82L and 82R.

Examples of the fixing means 24 include a hot roller fixing type fixing means including a heating roller provided with a heating source therein, and a pressure roller provided in a state of being pressure-welded such that fixing nip portion is formed on the heating roller.

In addition, in FIG. 2, 20 indicates a paper feeding cassette, 22A, 22B, 22C, and 22D indicate an intermediate roller, 23 indicates a resist roller, 25 indicates a paper discharge roller, 26 indicates a paper discharge tray, and P indicates a transfer material.

Furthermore, in FIG. 2, the image forming apparatus of the invention is illustrated as a color laser printer, but the tandem type electrophotographic image forming apparatus according to one embodiment of the invention may be configured as a copier. In addition, in the image forming apparatus according to one embodiment of the invention, a light source other than laser, for example, an LED light source can be used as an exposure light source.

In FIG. 2, the image forming apparatus including four image forming units corresponding to YMCK, has been described as a preferred example of the image forming apparatus of the invention, and an image forming apparatus further including an image forming unit corresponding to other colors, such as clear, white, gold, and silver, is also exemplified as a preferred example.

[Lubricant Supplying Means]

The tandem type electrophotographic image forming apparatus according to one embodiment of the invention includes the lubricant supplying means supplying the lubricant to the front surface of the organic photoreceptor.

The lubricant is not particularly limited, a known lubricant can be suitably selected, and it is preferable that a fatty acid metal salt is contained.

The fatty acid metal salt is not particularly limited, and a metal salt of a saturated or unsaturated fatty acid having carbon atoms of greater than or equal to 10, is preferable. Examples of the fatty acid metal salt include zinc laurate, barium stearate, lead stearate, iron stearate, nickel stearate, cobalt stearate, copper stearate, strontium stearate, calcium stearate, cadmium stearate, magnesium stearate, zinc stearate, aluminum stearate, indium stearate, potassium stearate, lithium stearate, sodium stearate, zinc oleate, magnesium oleate, iron oleate, cobalt oleate, copper oleate, lead oleate, manganese oleate, aluminum oleate, zinc palmitate, cobalt palmitate, lead palmitate, magnesium palmitate, aluminum palmitate, calcium palmitate, lead caprate, zinc linolenate, cobalt linolenate, calcium linolenate, zinc ricinoleate, cadmium ricinoleate, and the like. Among them, the zinc stearate is preferable from the viewpoint of lubricating properties, spreadability, and hygroscopic properties.

A synthetic product may be used, and a commercially available product may be used, as the fatty acid metal salt, and examples of the commercially available product include zinc stearate S manufactured by NOF CORPORATION, and the like.

Only one type of fatty acid metal salts may be independently used, or two or more types thereof may be used by being mixed.

The lubricant supplying means is not particularly limited, and examples of the lubricant supplying means include a means supplying the lubricant according to a method of applying a solid lubricant by a brush roller (hereinafter, also referred to as a "lubricant coating means").

In a case of using the lubricant coating means, for example, in the image forming unit 10Y of the electrophotographic image forming apparatus illustrated in FIG. 2, it is preferable that the lubricant coating means is disposed on the downstream side of the cleaning means 6Y and on the upstream side of the charging means 2Y, in the rotation direction of the photoreceptor 1Y. Here, the disposition of the lubricant coating means is not limited to the downstream side of the cleaning means 6Y and the upstream side of the charging means 2Y. The lubricant coating means is not particularly limited, and for example, it is preferable that the lubricant coating means includes a solid lubricant and a lubricant coating member including a brush roller. Specifically, it is preferable that the lubricant coating means includes a cubic lubricant stock including the solid lubricant, a brush roller applying the lubricant which is scraped out by abutting on the front surface of the photoreceptor 1Y, and by rubbing a front surface of the lubricant stock, onto the front surface of the photoreceptor 1Y, a pressure spring pressing the lubricant stock against the brush roller, and a driving mechanism rotatively driving the brush roller. In the brush roller, the tip end of the brush abuts on the front surface of the photoreceptor 1Y. In addition, it is preferable that the brush roller is rotatively driven at a constant speed with the same rotation as that in the rotation direction of the photoreceptor 1Y. A leveling blade homogeneously applying the lubricant supplied to the front surface of the photoreceptor 1Y by the lubricant coating means, may be disposed on the downstream side of the lubricant coating means and on the upstream side of the charging means 2Y. Furthermore, the lubricant coating means is not particularly limited, it is possible to suitably refer to a known means, and for example, it is possible to refer to Japanese Patent Application Laid-Open No. 2016-188950, and the like.

In addition, the lubricant supplying means is not particularly limited, and example of the lubricant supplying means include a means supplying a finely powdered lubricant externally added to toner base particles, to the organic photoreceptor (in FIG. 2 and FIG. 3 described above, for example, 1Y), according to the function of the developing electrical field formed in the developing means (in FIG. 2 and FIG. 3 described above, for example, 4Y) (hereinafter, also referred to as a "toner-containing means"). That is, the toner-containing means is a means supplying the finely powdered lubricant contained in the toner, to the organic photoreceptor, according to the function of the developing electrical field formed in the developing means. The toner-containing means is particularly preferable since the toner-containing means does not involve the intermediate member such as the brush roller, as with the lubricant coating means described above, and thus, a variation in a supplied amount of the lubricant due to the contamination of the lubricant, or the contamination or the deterioration of the intermediate member does not occur.

In the toner-containing means, mainly, the finely powdered lubricant contained in the toner as an external additive, is separated when the cleaning blade and the remaining toner (in particular, the reverse transfer toner) are in contact with each other, and thus, the lubricant is supplied to the organic photoreceptor. In a case of using the toner-containing means, in particular, the linear pressure of the cleaning blade included in the image forming unit disposed on the upstream side decreases, and thus, the occurrence frequency of the passing through of the toner remarkably decreases, and the lifetime of the organic photoreceptor and the electrophotographic image forming apparatus is remarkably improved. That is, the effects of the invention are improved by using the toner-containing means. It is assumed that this is because the finely powdered lubricant separated from the toner, is supplied to the front surface of the organic photoreceptor as a sufficient amount, without being scraped out and removed by the cleaning blade, and thus, the effect of the lubricant can be sufficiently obtained. In addition, in particular, the linear pressure of the cleaning blade included in the image forming unit disposed on the downstream side further increases, and thus, the occurrence frequency of the passing through of the toner remarkably decreases, organic photoreceptor, and the lifetime of the organic photoreceptor and the electrophotographic image forming apparatus is remarkably improved. It is assumed that this is because a balance of sufficiently supplying the finely powdered lubricant separated from the toner, is realized while realizing an excellent scraping effect of the toner. Here, such a mechanism is based on the assumption, and the right or wrong thereof does not affect the technical scope of the invention.

In the toner-containing means, the finely powdered lubricant is externally added to the toner base particles described below, as the external additive. A volume-based median size Dw of the finely powdered lubricant, is preferably 0.3 μm to 25 μm, and is more preferably 0.5 μm to 20 μm. According to the range described above, in a case where the size of the lubricant is properly small, an attachment force with respect to the toner base particles properly increases, and a transition in the developing means, rarely occurs, and thus, the lubricant is more sufficiently supplied. In addition, in a case where the size of the lubricant is properly large, the attachment force with respect to the toner base particles properly decreases, and thus, the transition of the lubricant to the organic photoreceptor more easily occurs. Accordingly, it is possible to homogeneously supply the lubricant onto the organic photoreceptor. Furthermore, the volume-based median size Dw of the lubricant can be obtained by being measured and calculated with a device in which a data processing computer system (manufactured by Beckman Coulter, Inc.) is connected to Coulter's Multisizer 3 (manufactured by Beckman Coulter, Inc.). In addition, a particle diameter of the lubricant in a state of being externally added to the toner base particles (colored particles), can also be measured by a known method such as electronic microscopic photography. An evaluation method of the volume-based median size Dw of the finely powdered lubricant, is capable of referring to the description of paragraphs "0031" and "0032", and the like of Japanese Patent Application Laid-Open No. 2010-175701. Furthermore, the details will be described in the examples.

An added amount of the finely powdered lubricant is preferably 0.01 parts by mass to 0.5 parts by mass, and is more preferably 0.03 parts by mass to 0.3 parts by mass, with respect to the total mass of the toner. According to the range described above, the effects of the invention are further exhibited while suppressing the influence of the toner on charging properties.

Furthermore, a mixing method of the toner base particles and the lubricant is not particularly limited, a known method can be suitably selected, and for example, the toner base particles and the lubricant can be mixed together by using a Henschel mixer (Registered Trademark) manufactured by NIPPON COKE & ENGINEERING CO., LTD., and the like.

[Toner and Developer]

In herein, "toner base particles" configure the base of "toner particles". The "toner base particles" contain at least a binder resin and a colorant, and as necessary, may contain other structural components such as a release agent (wax) and a charge control agent. The "toner base particles" will be referred to as the "toner particles" by adding the external additive to thereto. Then, a "toner" indicates an aggregate of the "toner particles".

In the tandem type electrophotographic image forming apparatus according to one embodiment of the invention, known various toners can be used without any particular limitation.

Any one of a pulverization toner and a polymerization toner can be used as the toner, and it is preferable to use the polymerization toner from the viewpoint of obtaining an image with high image quality.

The average particle diameter of the toner is not particularly limited, and is preferably 2 μm to 8 μm in the volume-based median size. According to such a range, it is possible to further increase resolution.

In addition, as described above, in a case of using the lubricant supplying means supplying the finely powdered lubricant contained in the toner, to the organic photoreceptor, according to the function of the developing electrical field formed in the developing means, the finely powdered lubricant can be externally added to the toner base particles, as the external additive.

In addition, inorganic particles such as silica and titania, having the average particle diameter of approximately 10 nm to 300 nm, and a polish of approximately 0.2 μm to 3 μm, can be externally added to the toner base particles, as the external additive, in a suitable amount.

In a case where the toner is used as a two-component developer, magnetic particles formed of a known material of the related art, such as a ferromagnetic metal such as iron, an alloy of the ferromagnetic metal, aluminum, lead, and the like, and a compound of the ferromagnetic metal, such as ferrite and magnetite, can be used as a carrier. Among them, the ferrite is particularly preferable.

In addition, it is preferable that a carrier covered with a resin, or a carrier in which magnetic particles are dispersed in a resin, a so-called resin dispersion type carrier, is used as the carrier. A coating resin composition is not particularly limited, and for example, a cyclohexyl methacrylate-methyl methacrylate copolymer and the like can be used.

A volume-based median size of the carrier is preferably in a range of 15 μm to 100 μm, and is more preferably in a range of 25 μm to 60 μm.

It is preferable that the concentration of the toner contained in the two-component developer, is greater than or equal to 4 mass % and less than or equal to 8 mass %.

The invention includes the following aspects and embodiments.

1. A tandem type electrophotographic image forming apparatus using an organic photoreceptor in which at least a charge generating layer and a charge transfer layer are sequentially laminated on a conductive support body, the apparatus including at least: a plurality of image forming units including an electrostatic latent image forming means forming an electrostatic latent image on the organic photoreceptor, a developing means forming a toner image by supplying a toner to the organic photoreceptor, and by developing the electrostatic latent image, a lubricant supplying means supplying a lubricant to a front surface of the organic photoreceptor, and a cleaning means removing the toner remaining on the front surface of the organic photoreceptor with a cleaning blade, in which when a linear pressure of a cleaning blade A included in the image forming unit disposed on an upstream side, is set to P1, and a linear pressure of a cleaning blade B included in the image forming unit disposed on a downstream side, is set to P2, at least one of combinations of two adjacent image forming units including toners having colors different from each other satisfies Equation (1) described below.

[Expression 10]

$$P2>P1 \quad (1)$$

2. The electrophotographic image forming apparatus according to 1 described above, in which the linear pressure P1 of the cleaning blade A included in the image forming unit disposed on the upstream side, and the linear pressure P2 of the cleaning blade B included in the image forming unit disposed on the downstream side satisfy Equation (2) described below.

[Expression 11]

$$P2-P1\geq 2 \text{ N/m} \quad (2)$$

3. The electrophotographic image forming apparatus according to 1 or 2 described above, in which in the combinations of the two adjacent image forming units including the toners having colors different from each other, all of the combinations not satisfying Equation (1) described above satisfy Equation (3) described below.

[Expression 12]

$$P2=P1 \quad (3)$$

4. The electrophotographic image forming apparatus according 1 or 2 described above, in which all of the combinations of the two adjacent image forming units having colors different from each other satisfy Equation (1) described above.

5. The electrophotographic image forming apparatus according to according to any one of 1 to 3 described above, in which when a universal hardness of an organic photoreceptor C included in the image forming unit disposed on the upstream side, is set to He, and a universal hardness of an organic photoreceptor D included in the image forming unit disposed on the downstream side, is set to Hd, at least one of the combinations of the two adjacent image forming units including the toners having colors different from each other satisfies Equation (4) described below.

[Expression 13]

$$Hd-Hc\geq 10 \text{ N/mm}^2 \quad (4)$$

6. The electrophotographic image forming apparatus according to according to any one of 1 to 5 described above, in which at least one of the organic photoreceptors further includes a protective layer on an outermost surface, and a universal hardness measured from the protective layer side is greater than or equal to 220 N/mm$^2$ and less than or equal to 320 N/mm$^2$.

7. The electrophotographic image forming apparatus according to 6 described above, in which the protective layer contains a cured resin component which is a cured material of a polymerizable compound.

8. The electrophotographic image forming apparatus according to 6 or 7 described above, in which the protective layer contains metal oxide particles.

9. The electrophotographic image forming apparatus according to any one of 6 to 8 described above, in which the protective layer contains a charge transfer agent having a structure represented by General Formula (1) described below.

[Chemical Formula 7]

General Formula (1)

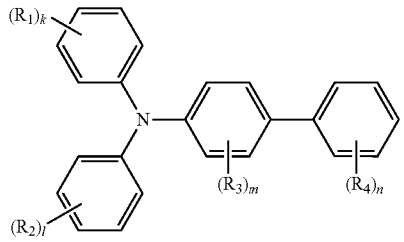

[In General Formula (1), $R_1$, $R_2$, $R_3$, and $R_4$ each independently represent an alkyl group having 1 to 7 carbon atoms or an alkoxy group having 1 to 7 carbon atoms. k, l, and n each independently represent an integer of 0 to 5, and m represents an integer of 0 to 4. Here, in a case in which k, l, n, or m is greater than or equal to 2, a plurality of $R_1$s, $R_2$s, $R_3$s, or $R_4$s may be identical to each other, or different from each other.]

10. The electrophotographic image forming apparatus according to any one of 6 to 9 described above, in which the protective layer contains a radical scavenger having a structure represented by General Formula (2) described below.

[Chemical Formula 8]

General Formula (2)

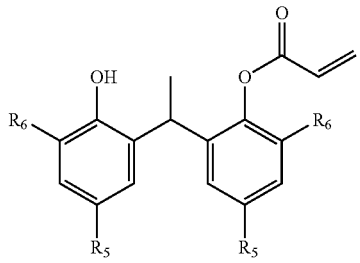

[In General Formula (2) described above, $R_5$ and $R_6$ each independently represent an alkyl group having 1 to 6 carbon atoms.]

11. The electrophotographic image forming apparatus according to any one of 1 to 10 described above, in which the lubricant contains a fatty acid metal salt.

12. The electrophotographic image forming apparatus according to any one of 1 to 11 described above, in which the lubricant supplying means is a means supplying the finely powdered lubricant contained in the toner, to the organic photoreceptor, according to a function of a developing electrical field formed in the developing means.

As described above, the embodiments of the invention have been described in detail, but the embodiments of the invention are not limited to the examples described above, and various changes can be added to thereto.

EXAMPLES

The effects of the invention will be described by using the following examples and comparative examples. In the following examples, unless otherwise noted, "parts" and "%" respectively indicate "parts by mass" and "mass %". Furthermore, the invention is not limited to the following examples.

<Manufacturing of Organic Photoreceptor>

Hereinafter, structural formulas of compounds used in the examples will be represented.

[Chemical Formula 9]

Compound A

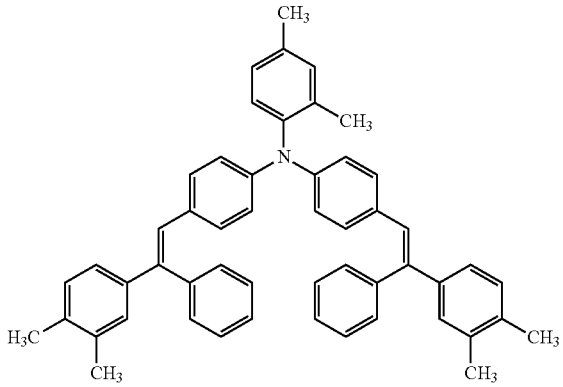

M1

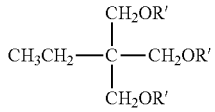

P1

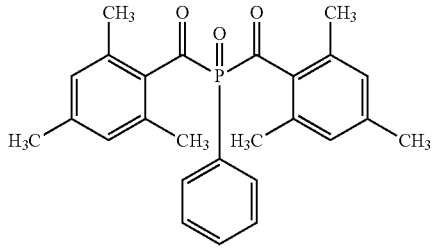

CTM-1

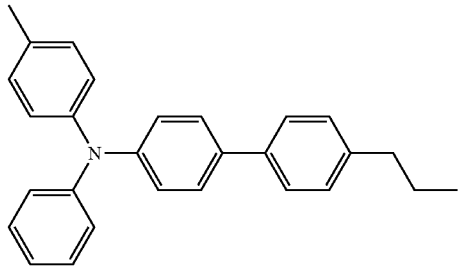

[Manufacturing of Organic Photoreceptor [1]]

(Preparation of Conductive Support Body)

A front surface of a cylindrical aluminum support body having a diameter of 30 mm was subjected to cutting processing such that the front surface was finely roughened, and thus, a conductive support body [1] was prepared.

(Formation of Interlayer)

A dispersion liquid of the following compositions was diluted twice in the same mixed solvent, and was left to stand overnight, and then, was filtered (Filter; A filter having Rigimesh of 5 μm, manufactured by Pall Corporation, was used), and thus, a coating liquid [1] for forming an interlayer was prepared.

| | |
|---|---|
| Binder Resin: Polyamide Resin "CM8000" (manufactured by TORAY INDUSTRIES, INC.) | 1 part |
| Metal Oxide Particles: Oxide Titanium "SMT500SAS" (manufactured by TAYCA CORPORATION) | 3 parts |
| Solvent: Methanol | 10 parts |

Dispersion was performed for 10 hours in a batch system, by using a sand mill as a disperser. The coating liquid [1] for forming an interlayer was applied onto the conductive support body [1] by an immersion coating method, and thus, an interlayer [1] having a dried layer thickness of 2 μm was formed.

(Formation of Charge Generating Layer)

| | |
|---|---|
| Charge Generating Substance: Charge Generating Substance (CG-1) Described below | 20 parts |
| Binder Resin: Polyvinyl Butyral Resin "#6000-C" (manufactured by Denka Company Limited) | 10 parts |
| Solvent: Tert-Butyl Acetate | 700 parts |
| Solvent: 4-Methoxy-4-Methyl-2-Pentanone | 300 parts |

were mixed, and were dispersed for 10 hours by using a sand mill, and thus, a coating liquid [1] for forming a charge generating layer was prepared. The coating liquid [1] for forming a charge generating layer was applied onto the interlayer [1] by an immersion coating method, and thus, a charge generating layer [1] having a dried layer thickness of 0.3 μm was formed.

(Synthesis of Charge Generating Substance (CG-1))

(1) Synthesis of Amorphous Titanyl Phthalocyanine 29.2 parts by mass of 1,3-diiminoisoindoline was dispersed in 200 parts by mass of o-dichlorobenzene, 20.4 parts by mass of titanium tetra-n-butoxide was added thereto, and heating was performed at 150° C. to 160° C. for 5 hours in a nitrogen atmosphere. Cooling was performed, and then, precipitated crystals were filtered, washing was performed with chloroform, an aqueous solution of a hydrochloric acid of 2%, water, and methanol, and drying was performed, and then, 26.2 parts by mass (a yield of 91%) of crude titanyl phthalocyanine was obtained.

Next, crude titanyl phthalocyanine was dissolved by being stirred, in 250 parts by mass of a concentrated sulfuric acid, at a temperature of lower than or equal to 5° C. for 1 hour, and was poured into 5000 parts by mass of water at 20° C. Precipitated crystals were filtered, water washing was sufficiently performed, and thus, 225 parts by mass of a wet-paste item was obtained.

The wet-paste item was frozen in a freezer, and was defrosted again, and then, was filterer and dried, and thus, 24.8 parts by mass of amorphous titanyl phthalocyanine (a yield of 86%) was obtained.

(2) Synthesis of (2R,3R)-2,3-Butanediol Adduct Titanyl Phthalocyanine 10.0 parts by mass of amorphous titanyl phthalocyanine described above, and 0.94 parts by mass of (2R,3R)-2,3-butanediol (an equivalent ratio of 0.6) (the equivalent ratio is an equivalent ratio with respect to titanyl phthalocyanine, the same applies to the following) were mixed in 200 parts by mass of orthodichlorobenzene (ODB), and were heated and stirred at 60 to 70° C. for 6.0 hours. The mixture was left to stand overnight, and then, crystals generated by adding methanol to the reaction liquid, were filtered, and the crystals after being filtered were washed with methanol, and thus, 10.3 parts by mass of a charge generating substance containing (2R,3R)-2,3-butanediol adduct titanyl phthalocyanine (CG-1) was obtained.

In an X-ray diffraction spectrum of the charge generating substance (CG-1), there are clear peaks at 8.30, 24.7°, 25.1°, and 26.5°. In a mass spectrum, there are peaks at 576 and 648, and in an IR spectrum, both absorptions of Ti═O in the vicinity of 970 $cm^{-1}$ and O—Ti—O in the vicinity of 630 $cm^{-1}$ appear. In addition, in thermal analysis (TG), a mass decrease of approximately 7% occurs at 390° C. to 410° C., and thus, a mixture of an adduct of 1:1 of titanyl phthalocyanine and (2R,3R)-2,3-butanediol, and a non-adduct (not added) of titanyl phthalocyanine, is assumed. A BET specific surface area of the obtained charge generating substance (CG-1) was measured by a fluid specific surface area automatic measurement device (micrometric flow soap type: manufactured by SHIMADZU CORPORATION), and was 31.2 $m^2/g$.

(Formation of Charge Transfer Layer)

225 parts of the compound A described above, as a charge transfer substance, 300 parts of a polycarbonate resin "Z300" (manufactured by Mitsubishi Gas Chemical Company, Inc.), as a binder resin, 6 parts of "Irganox (Registered Trademark) 1010" (manufactured by BASF SE), as an antioxidant, 1600 parts of tetrahydrofuran (THF), as a solvent, 400 parts of toluene, as a solvent, and 1 part of silicone oil "KF-50" (manufactured by Shin-Etsu Polymer Co., Ltd.) were mixed and dissolved, and thus, a coating liquid [1] for forming a charge transfer layer was prepared.

The coating liquid [1] for forming a charge transfer layer was applied onto the charge generating layer [1] by using a circular slide hopper coating device (a circular amount regulating type coating device), and thus, a charge transfer layer [1] having a dried layer thickness of 20 μm was formed. At this time, the universal hardness of the organic photoreceptor, measured from the charge transfer layer side, which is the outermost surface layer, was 180 $N/mm^2$.

[Manufacturing of Organic Photoreceptor [2]]

(Formation of Protective Layer)

164 parts of tin oxide particles [1], as metal oxide particles described below, 100 parts of Exemplary Compound (M1) described above (in the formula, R' represents a methacryloyl group ($CH_2$═$CCH_3CO$—)), as a polymerizable compound, 17 parts of Exemplary Compound (CTM-1) described above, as a charge transfer agent, 9 parts of Exemplary Compound (P1) described above, as a polymerization initiator, 21 parts of "SUMILIZER (Registered Trademark) GS (in General Formula (2) described above, $R_5$ represents a tert-pentyl group, and $R_6$ represents tert-pentyl group)" (manufactured by Sumitomo Chemical Company, Limited), as a radical scavenger, 280 parts of 2-butanol, as a solvent, and 70 parts of tetrahydrofuran, as a solvent, were mixed and stirred, and were sufficiently dissolved and dispersed, and thus, a coating liquid [1] for forming a protective layer was prepared. The coating liquid [1] for forming a protective layer was applied onto the charge transfer layer of the organic photoreceptor [1] by using a circular slide hopper coating device, and thus, a coated film was formed, and a distance from a light source to a front surface of the coated film was set to 100 mm by using a metal halide lamp, in a nitrogen stream, and an ultraviolet ray was emitted at lamp output of 4 kW for 1 minutes, a protective layer having a dried layer thickness of 4.0 μm was formed. Thus, an organic photoreceptor [2] was obtained. At this time, the universal hardness of the organic photoreceptor, measured from the protective layer side, which is the outermost surface layer, was 220 N/mm$^2$.

(Preparation of Tin Oxide Particles [1])

Tin oxide [1] described below was used as the untreated metal oxide particles, Exemplary Compound (S-15) described above was used as a surface modifier, and surface modification was performed as follows, and thus, tin oxide particles [1] were prepared.

First, tin oxide manufactured by CIK Nanotech Co., Ltd. (a number average primary particle diameter of 20 nm, and a volume resistivity of $1.05\times10^5$ (Ω·cm)), was prepared as tin oxide [1].

Next, a mixed liquid of 100 parts of the tin oxide [1], 30 parts of a surface modifier (Exemplary Compound (S-15): $CH_2{=}C(CH_3)COO(CH_2)_3Si(OCH_3)_3$), and 300 parts of a mixed solvent of toluene/isopropyl alcohol=1/1 (a mass ratio), was put into a sand mill along with zirconia beads, and was stirred at approximately 40° C. and a rotation speed of 1500 rpm, and thus, the surface modification was performed. Further, the treated mixture was taken out, was put into a Henschel mixer (Registered Trademark), and was stirred at a rotation speed of 1500 rpm for 15 minutes, and then, was dried at 120° C. for 3 hours, and thus, the surface modification was ended, and tin oxide particles [1] subjected to the surface modification, were prepared.

[Manufacturing of Organic Photoreceptors [3] to [10]]

Organic photoreceptors [3] to [10] were manufactured by the same method as that in the manufacturing of the organic photoreceptor [2], except that in the formation of the protective layer, the added amounts (parts) of the polymerizable compound (M1), the polymerization initiator (P1), the radical scavenger (SUMILIZER (Registered Trademark) GS), the tin oxide particles [1], and the charge transfer substance (CTM-1), to be used, were changed according to Table 1 described below.

In addition, the universal hardness of each of the organic photoreceptors [3] to [10] was measured by the same method as that of the organic photoreceptor [2].

<Evaluation of Organic Photoreceptor>

[Universal Hardness (HU)]

The universal hardness of the organic photoreceptor was measured from the charge transfer layer side or the protective layer side, which is the outermost surface layer, on a side opposite to the conductive support body side.

The universal hardness was defined by Equations (8) and (9) described below.

[Expression 14]

$$HU = \frac{F}{A(h)} = \frac{F}{26.43\times h^2} \quad \text{Equation (8)}$$

$$A(h) = \frac{4\times\sin(a/2)}{\cos^2(a/2)}\times h^2 \quad \text{Equation (9)}$$

In Equation (8) and Equation (9) described above, F is a test load (N), A(h) is a surface area (mm$^2$) of an indenter, in contact with an object to be measured, and h is an indentation depth (mm) when the test load acts. A(h) is calculated from the shape of the indenter and the indentation depth, and in a case where the indenter is a Vickers indenter, $26.43\times h^2$ is calculated from an angle a (136°) of a surface facing a pyramid-like penetration body.

The universal hardness (HU) is measured by using an ultra-microhardness tester "H-100V" (manufactured by Fischer Instruments K.K.), in a measurement condition described below.

(Measurement Condition)

Measuring Machine: Ultra-Microhardness Tester "H-100V" (manufactured by Fischer Instruments K.K.), Shape of Indenter: Vickers Indenter (a=136°), Measurement Environment: 20° C. and 60% RH, Maximum Test Load: 3 mN, Loading Speed: 3 mN/20 sec, Maximum Load Creep Time: 5 seconds, and Unloading Speed: 3 mN/20 sec.

Furthermore, in the measurement of all samples, total 15 points of 5 points at an equal interval in an axial direction and 3 points at an equal angle in a circumferential direction, were measured, and the average value thereof was set to the universal hardness.

In each of the organic photoreceptors, the presence or absence of the protective layer, and the protective layer forming material, and the measurement result of the universal hardness are shown in Table 1 and Table 2 described below. Furthermore, a volume ratio of each component in Table 2 described below, was calculated from a mass ratio by setting the total of each of the components excluding a solvent to 100, by setting specific weight of tin oxide to 6.95, and by setting specific weight of other organic materials to 1.1.

TABLE 1

Mass Ratio of Each Component of Protective Layer Forming Material of Organic Photoreceptor and Universal Hardness

| | Protective Layer | | | | | | Universal Hardness Measured from Outermost Layer (N/mm$^2$) |
|---|---|---|---|---|---|---|---|
| | | Prescription | | | | | |
| Organic Photoreceptor | Presence or Absence | Polymerizable Compound [M1] | Tin Oxide [1] | Charge Transfer Agent [CTM-1] | Radical Scavenger [GS] | Poly-merization Initiator [P1] | |
| [1] | Absent | — | — | — | — | — | 180 |
| [2] | Present | 100 | 164 | 17 | 21 | 9 | 220 |

TABLE 1-continued

| Mass Ratio of Each Component of Protective Layer Forming Material of Organic Photoreceptor and Universal Hardness | | | | | | | |
|---|---|---|---|---|---|---|---|
| | Protective Layer | | | | | | Universal Hardness Measured from Outermost Layer ($N/mm^2$) |
| | | Prescription | | | | | |
| Organic Photoreceptor | Presence or Absence | Polymerizable Compound [M1] | Tin Oxide [1] | Charge Transfer Agent [CTM-1] | Radical Scavenger [GS] | Poly-merization Initiator [P1] | |
| [3] | Present | 100 | 159 | 17 | 17 | 8 | 230 |
| [4] | Present | 100 | 154 | 16 | 13 | 8 | 240 |
| [5] | Present | 100 | 148 | 16 | 9 | 8 | 250 |
| [6] | Present | 100 | 144 | 15 | 6 | 8 | 260 |
| [7] | Present | 100 | 140 | 15 | 3 | 7 | 270 |
| [8] | Present | 100 | 136 | 15 | 0 | 7 | 280 |
| [9] | Present | 100 | 127 | 7 | 0 | 7 | 300 |
| [10] | Present | 100 | 118 | 0 | 0 | 6 | 320 |

In Table, [GS] Indicates SUMILIZER (Registered Trademark) GS (Manufactured by Sumitomo Chemical Company, Limited).

TABLE 2

| Volume Ratio of Each Component When Total Volume of Protective Layer Forming Material of Organic Photoreceptor is Set to 100, and Universal Hardness | | | | | | | |
|---|---|---|---|---|---|---|---|
| | Protective Layer | | | | | | Universal Hardness Measured from Outermost Layer ($N/mm^2$) |
| | | Prescription | | | | | |
| Organic Photoreceptor | Presence or Absence | Polymerizable Compound [M1] | Tin Oxide [1] | Charge Transfer Agent [CTM-1] | Radical Scavenger [GS] | Polymerization Initiator [P1] | |
| [1] | Absent | — | — | — | — | — | 180 |
| [2] | Present | 58 | 15 | 10 | 12 | 5 | 220 |
| [3] | Present | 60 | 15 | 10 | 10 | 5 | 230 |
| [4] | Present | 62 | 15 | 10 | 8 | 5 | 240 |
| [5] | Present | 64 | 15 | 10 | 6 | 5 | 250 |
| [6] | Present | 66 | 15 | 10 | 4 | 5 | 260 |
| [7] | Present | 68 | 15 | 10 | 2 | 5 | 270 |
| [8] | Present | 70 | 15 | 10 | 0 | 5 | 280 |
| [9] | Present | 75 | 15 | 5 | 0 | 5 | 300 |
| [10] | Present | 80 | 15 | 0 | 0 | 5 | 320 |

In Table, [GS] Indicates SUMILIZER (Registered Trademark) GS (Manufactured by Sumitomo Chemical Company, Limited).

<Manufacturing of Developer>

[Preparation of Colorant Dispersion Liquid]

(Preparation of Colorant Dispersion Liquid [K])

90 g of sodium dodecyl sulfate was stirred and dissolved in 1600 ml of ion exchange water. 420 g of carbon black (REGAL 330R: manufactured by Cabot Corporation) was gradually added while stirring the solution, and then, and a dispersion treatment was performed by using a stirring device "CLEARMIX" (manufactured by M Technique Co., Ltd.), and thus, a dispersion liquid of colorant particles was prepared. The dispersion liquid was set to a "colorant dispersion liquid 1". A particle diameter of the colorant particles in the colorant dispersion liquid [K], was measured by using a electrophoretic light scattering photometer "ELS-800" (manufactured by Otsuka Electronics Co., Ltd.), and was 110 nm.

(Preparation of Colorant Dispersion Liquid [C])

A colorant dispersion liquid [C] was prepared in which colorant particles having a particle diameter of 112 nm in a volume-based median size, were dispersed, by the same method as that of the colorant dispersion liquid [K], except that in the preparation example of the colorant dispersion liquid [K], C.I. Pigment Blue 15:3 was used as the colorant, instead of carbon black.

(Preparation of Colorant Dispersion Liquid [M])

A colorant dispersion liquid [M] was prepared in which colorant particles having a particle diameter of 115 nm in the volume-based median size, were dispersed, by the same method as that of the colorant dispersion liquid [K], except that in the preparation example of the colorant dispersion liquid [K], C.I. Pigment red 122 was used as the colorant, instead of carbon black.

(Preparation of Colorant Dispersion Liquid [Y])

A colorant dispersion liquid [Y] was prepared in which colorant particles having a particle diameter of 118 nm in the volume-based median size, were dispersed, by the same method as that of the colorant dispersion liquid [K], except that in the preparation example of the colorant dispersion liquid [K], C.I. Pigment Yellow 74 was used as the colorant, instead of carbon black.

[Preparation of Toner Base Particles]

(Preparation of Toner Base Particles [1])

(Manufacturing of Resin Particles A)

First Stage Polymerization 8 g of sodium dodecyl sulfate and 3 L of ion exchange water were put into a reaction vessel of 5 L, provided with a stirring device, a temperature sensor, a cooling pipe, and a nitrogen introduction device, and were heated such that an inner temperature was raised to 80° C., while being stirred at a stirring speed of 230 rpm in a nitrogen stream. The temperature was raised, and then, a mixture obtained by dissolving 10 g of potassium persulfate in 200 g of ion exchange water, was added, a liquid temperature was set again to 80° C., and a monomer mixed liquid described below was dropped for 1 hour, and then, polymerization was performed by performing heating and stirring at 80° C. for 2 hours, and thus, resin particles were prepared. The prepared resin particles are set to "resin particles (1H)".

Styrene 480 g
n-Butyl Acrylate 250 g
Methacrylic Acid 68.0 g
n-Octanethiol 16.0 g Second Stage Polymerization A solution in which 7 g of polyoxime ethylene (2) sodium dodecyl ether sulfate was dissolved in 800 ml of ion exchange water, was put into a reaction vessel of 5 L, provided with a stirring device, a temperature sensor, a cooling pipe, and a nitrogen introduction device. Heating was performed at 98° C., and then, 260 g of the resin particles (1H), and solution in which a monomer solution described below was dissolved at 90° C., were added, and mixing and dispersion were performed by a mechanical disperser CLEARMIX (manufactured by M Technique Co., Ltd.) including a circulation route, for 1 hour, and thus, a dispersion liquid containing emulsified particles (an oil droplet), was prepared.

Styrene 223 g
n-Butyl Acrylate 142 g
n-Octanethiol 1.5 g
Polyethylene Wax (a melting point of 70° C.) 190 g Next, an initiator solution in which 6 g of potassium persulfate was dissolved in 200 ml of ion exchange water, was added to the dispersion liquid, and polymerization was performed by heating and stirring such a system at 82° C. for 1 hour, and thus, resin particles were prepared. The prepared resin particles were set to "resin particles (1HM)".

Third Stage Polymerization

Further, a solution in which 11 g of potassium persulfate was dissolved in 400 ml of ion exchange water, was added, and in a temperature condition of 82° C., a monomer mixed liquid formed of:

Styrene 405 g
n-Butyl Acrylate 162 g
Methacrylic Acid 33 g
n-Octanethiol 8 g was dropped for 1 hour. The dropping was ended, and then, polymerization was performed by performing heating and stirring for 2 hours, and then, cooling was performed to 28° C., and thus, a dispersion liquid of the resin particles was prepared. The prepared dispersion liquid was set to a dispersion liquid of "resin particles A". A part of the dispersion liquid of the resin particles A was sampled, and Tg of the resin particles A was measured after washing and drying the sampled dispersion liquid, and was 21° C.

(Preparation of Resin Particles B)

2.3 g of sodium dodecyl sulfate and 3 L of ion exchange water were put into a reaction vessel of 5 L, provided with a stirring device, a temperature sensor, a cooling pipe, and a nitrogen introduction device, and were heated such that an inner temperature was raised to 80° C., while being stirred at a stirring speed of 230 rpm in a nitrogen stream. The temperature was raised, and then, a mixture obtained by dissolving 10 g of potassium persulfate in 200 g of ion exchange water, was added, and a liquid temperature was set again to 80° C., and a monomer mixed liquid described below was dropped for 1 hour, and then, polymerization was performed by performing heating and stirring at 80° C. for 2 hours, and thus, resin particles were prepared, and a dispersion liquid of the resin particles was prepared. The prepared dispersion liquid was set to a dispersion liquid of "resin particles B".

Styrene 520 g
n-Butyl Acrylate 210 g
Methacrylic Acid 68.0 g
n-Octanethiol 16.0 g.

A part of the dispersion liquid of the resin particles B was sampled, and Tg of the resin particles B was measured after washing and drying the sampled dispersion liquid, and was 48° C.

(Flocculation and Fusion Step)

A solution in which 300 g of the resin particles A in terms of solid contents, 1400 g of ion exchange water, 120 g of the "colorant dispersion liquid [K]", and 3 g of the polyoxime ethylene (2) sodium dodecyl ether sulfate were dissolved in 120 ml of ion exchange water, was put into a reaction vessel of 5 L, provided with a stirring device, a temperature sensor, a cooling pipe, and a nitrogen introduction device, a liquid temperature was adjusted to 30° C., and pH was adjusted to 10 by adding an aqueous solution of sodium hydroxide of 5 N. Next, an aqueous solution in which 35 g of magnesium chloride was dissolved in 35 ml of ion exchange water, was added by being stirred, at 30° C. for 10 minutes. Retention was performed for 3 minutes, the temperature is started to be raised, such a system was heated such that the temperature was raised to 90° C. for 60 minutes, and a particle growth reaction was continuously performed while retaining 90° C. In such a state, a particle diameter of the associated particles was measured by "Coulter's Multisizer 3", 260 g of the dispersion liquid of the resin particles B was added at a time point when a volume-based median size was 3.1 μm, and the particle growth reaction was continuously performed. An aqueous solution in which 150 g of sodium chloride was dissolved in 600 ml of ion exchange water, was added at a time point when a desired particle diameter was obtained, the particle growth was stopped, and heating and stirring were performed at a liquid temperature of 98° C., as a fusion step, and thus, fusion between particles progressed until a degree of circularity, measured by FPIA-2100, became 0.965. After that, cooling was performed to a liquid temperature of 30° C., pH was adjusted to 4.0 by adding a hydrochloric acid, and stirring was stopped.

(Washing and Drying Step)

The particles generated in the flocculation and fusion step, were subjected to solid-liquid separation by a basket type centrifuge separator "MARK III model number 60×40" (manufactured by Matsumoto Machinery Sales Co., Ltd.), and thus, a wet cake of the toner base particles was formed. The wet cake was washed with ion exchange water at 45° C. until an electrical conductivity of a filtrate, measured by the basket type centrifuge separator, became 5 μS/cm, and then, is moved to a "flash jet drier" (manufactured by Sicin Corporation), is dried until the amount of moisture became 0.5 mass %, and thus, toner base particles [1] were prepared.

(Preparation of Toner Base Particles [2])

Toner base particles [2] were prepared by the same method as that of the toner base particles [1], except that in the preparation step of the toner base particles [1], the colorant dispersion liquid was changed to a colorant dispersion liquid [C].

(Preparation of Toner Base Particles [3])

Toner base particles [3] were prepared by the same method as that of the toner base particles [1], except that in the preparation step of the toner base particles [1], the colorant dispersion liquid was changed to a colorant dispersion liquid [M].

(Preparation of Toner Base Particles [4])

Toner base particles [4] were prepared by the same method as that of the toner base particles [1], except that in the preparation step of the toner base particles [1], the colorant dispersion liquid was changed to a colorant dispersion liquid [Y].

[Preparation of Toner]

(Preparation of Toner [1])

0.6 parts by mass of silica particles NAX-50 (manufactured by Nippon Aerosil Co., Ltd.), 0.6 parts by mass of silica particles R805 (manufactured by Nippon Aerosil Co., Ltd.), 0.2 parts by mass of titania particles STT30S (manufactured by Titan Industry Co., Ltd.), and 0.05 parts by mass of stearate zinc particles (Product Name: zinc stearate S, manufactured by NOF CORPORATION, a volume-based median size Dw of 15 μm), which is a finely powdered lubricant, were added to 100 parts by mass of the toner base particles [1], and were mixed at a stirring blade circumferential speed of 40 m/second and a treatment temperature of 30° C. for 12 minutes, by using a Henschel mixer (Registered Trademark) "FM10B" (manufactured by NIPPON COKE & ENGINEERING CO., LTD.). After that, coarse particles were removed by using a sieve having a sieve opening of 90 μm, and thus, a toner [1] was prepared.

Here, the volume-based median size Dw of the finely powdered lubricant was evaluated by being measured and calculated with a device in which a data processing computer system (manufactured by Beckman Coulter, Inc.) is connected to Coulter's Multisizer 3 (manufactured by Beckman Coulter, Inc.). As a measurement procedure, 0.02 g of the finely powdered lubricant was blended into 20 ml of a surfactant solution (a surfactant solution in which neutral detergent containing a surfactant component was diluted 10 times by pure water), and then, ultrasonic dispersion was performed for 1 minute, and thus, a lubricant dispersion liquid was prepared. The lubricant dispersion liquid was injected into a beaker to which ISOTON II (manufactured by Beckman Coulter, Inc.) in a sample stand, was put, by using a pipette, such that a measuring machine display density became 5% to 10%. In the measuring machine, the number of counts of the measured particles was set to 25000, and an aperture diameter was set to 50 μm, and a range of 1 μm to 30 μm, which is a measurement range, was divided into 256, and thus, a frequency value was calculated. Then, a particle diameter of 50% from one having a large volume integrated fraction, was set to the volume-based median size.

(Preparation of Toners [2] to [4])

Toners [2] to [4] were prepared by the same method as that of the toner [1], except that in the preparation step of the toner [1], the toner base particles [1] were changed to toner base particles [2] to [4].

[Manufacturing of Developer]

(Manufacturing of Two-Component Developer [1])

A ferrite carrier having a volume-based median size of 33 μm, which was coated with a copolymer (a monomer ratio of 1:1) of cyclohexyl methacrylate and methyl methacrylate, was mixed with the toner [1], such that a toner concentration became 6.0 mass %, and thus, a two-component developer [1] was manufactured.

(Manufacturing of Two-Component Developers [2] to [4])

Two-component developers [2] to [4] were manufactured by the same method as that of the two-component developer [1], except that in the preparation of the two-component developer [1], the toner [1] was changed to each of toners [2] to [4].

<Manufacturing of Electrophotographic Image Forming Apparatus>

In the electrophotographic image forming apparatus, bizhub C360 (bizhub: Registered Trademark, manufactured by Konica Minolta Corporation) was used. Bizhub C360 is a tandem type color multi-function peripheral (MFP) performing laser exposure of a wavelength of 780 nm, and intermediate transfer performing reverse developing.

More specifically, bizhub C360 (bizhub: Registered Trademark, manufactured by Konica Minolta Corporation) includes four adjacent image forming units including toners having colors different from each other, and each of the image forming units includes a charging means charging a front surface of an organic photoreceptor, an exposure means (an electrostatic latent image forming means) forming an electrostatic latent image by exposing the organic photoreceptor charged by the charging means, a developing means forming a toner image by supplying the toner to the organic photoreceptor, and by developing the electrostatic latent image, a transfer means transferring the toner image formed on the organic photoreceptor, a lubricant supplying means supplying a lubricant to the front surface of the organic photoreceptor, and a cleaning means remove the toner remaining on the front surface of the organic photoreceptor, with a cleaning blade.

Here, each of the developers [1] to [4] manufactured as described above, was loaded on each of the four adjacent image forming units. In addition, each of the organic photoreceptors [1] to [10] prepared as described above was mounted on the four image forming units described above, in a combination as shown in Table 3 described below, as the organic photoreceptor of the four image forming units, and each of electrophotographic image forming apparatuses according to the examples and the comparative examples, was manufactured.

Here, the lubricant supplying means described above is a means (a toner-containing means) supplying the finely powdered lubricant externally added to the toner, to the organic photoreceptor, according to a function of a developing electrical field formed in the developing means.

<Evaluation of Electrophotographic Image Forming Apparatus>

(Linear Pressure of Cleaning Blade)

The linear pressure of the cleaning blade was measured by using a strain gage type load converter 9E01-L43-10N (manufactured by Nippon Avionics Co., Ltd.). A specific measurement method is described by using FIG. 4A to FIG. 5.

Figure 4A:
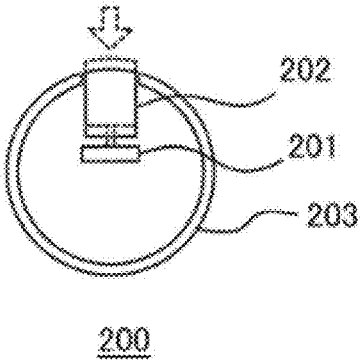
FIGS. 4A and 4B are meansal schematic views of a jig for measuring a linear pressure of the cleaning blade used in examples.
Figure 4B:
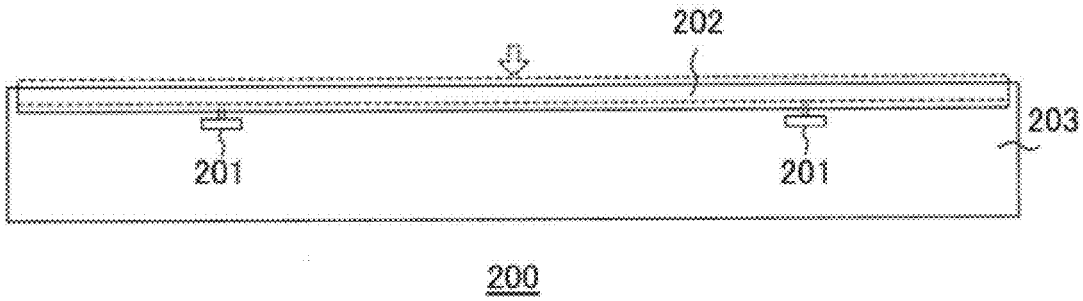

FIGS. 4A and 4B are meansal schematic views of a jig for measuring the linear pressure of the cleaning blade. Here, FIG. 4A is a meansal schematic view in a surface of a tool 200 for measuring the linear pressure of the cleaning blade, the surface being perpendicular to a rotation axis direction of a cylindrical member 203, and FIG. 4B is a meansal schematic view in a surface of the tool 200, the surface being parallel to the rotation axis direction of the cylindrical member 203.

First, as illustrated in FIGS. 4A and 4B, as the measuring tool 200, a load converter 201 and a pressure unit 202 were incorporated in the cylindrical member 203, and thus, a pseudo cleaning facing member for measurement was prepared. At this time, a circumferential curved surface of the pressure unit 202 had the same curvature radius of the outer surface of each of the organic photoreceptors, which are an object to be measured. Here, the cleaning blade was pressure-welded to the measuring tool 200 by using an attachment member having predetermined setting, and thus, a load was measured. The linear pressure was calculated from a load in a contact portion, and a distance between the cleaning blade and the pressure unit of the measuring tool in an axial direction of the cylindrical member in the contact portion, according to Equation (10) described below.

[Expression 15]

$$\text{Linear Pressure} = \text{Load in Contact Portion}/\text{Distance in Axial Direction of Cylindrical Member} \quad (10)$$

An actual measurement value was used as the linear pressure, from the same reason as that of an abutting angle.

Figure 5:
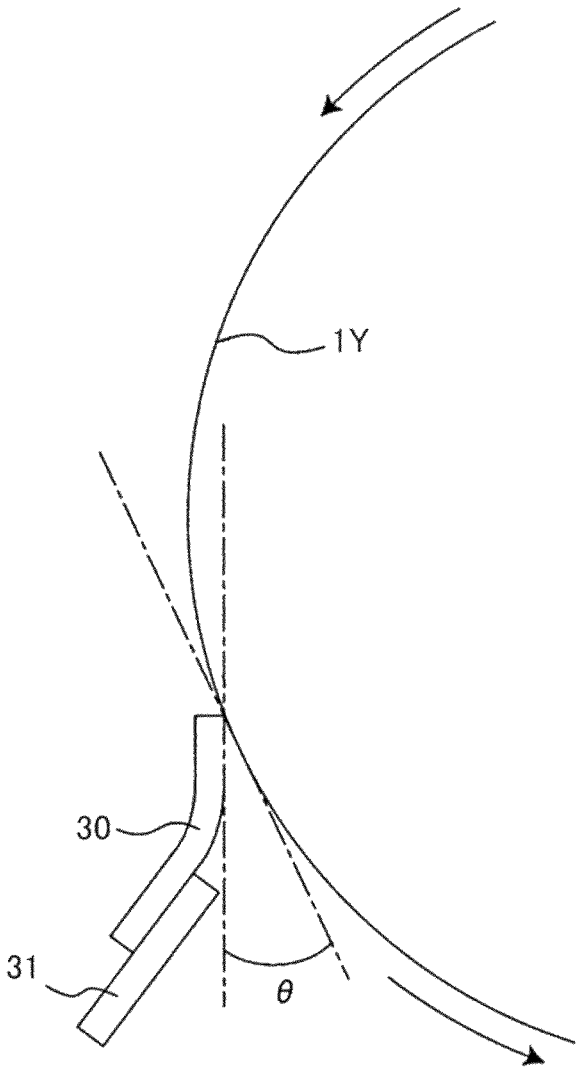
FIG. 5 is an enlarged schematic view of the vicinity of the cleaning blade included in an image forming unit, in the tandem type electrophotographic image forming apparatus according to one embodiment of the invention.

In addition, FIG. 5 is an enlarged schematic view of the vicinity of the cleaning blade included in the image forming unit, in the tandem type electrophotographic image forming apparatus according to one embodiment of the invention. In this evaluation, and the evaluation of passing through and the evaluation of the lifetime, described below, as illustrated in FIG. 5, the linear pressure of the cleaning blade was controlled by adjusting the deflection of the cleaning blade according to the disposition of the support member 31 supporting the blade member 30 of the cleaning blade.

A durability test was performed in which an A4 image having a print area rate of 5% with respect to each color of YMCK, was printed and output on 300000 A4 neutral papers, in an atmosphere of 20° C. and relative humidity of 50% RH, and then, image evaluation (passing through) and lifetime evaluation of each of the photoreceptors were performed as follows.

(Evaluation of Passing Through)

Figure 6A:
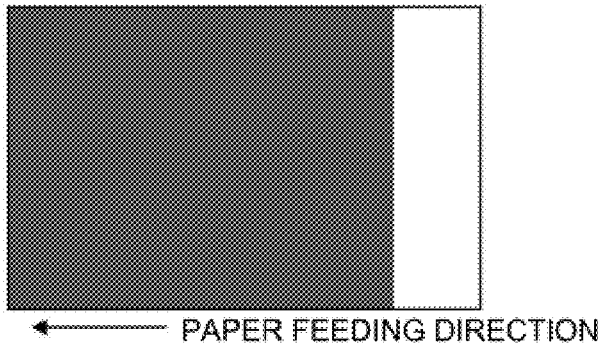
FIG. 6A is an explanatory diagram illustrating an evaluation method of the electrophotographic image forming apparatus.

After the durability test described above, a half-tone image (a) (refer to FIG. 6A) having a coverage rate of 80% was printed on 20000 A3 neutral papers, in an environment of 10° C. and 15% RH, such that a black background portion was positioned in a front portion in a transport direction of the paper, and a white background portion is positioned in a rear portion, a white background portion of the 20000-th paper was visually observed, and the passing through of the toner was evaluated on the basis of the following standard. In a case where the evaluation result was "⊙" and "○", it was determined as acceptable.

[Evaluation Standard]

⊙: A contamination was not observed in the white background portion

○: A slight string-like contamination was generated in the white background portion, but was not practically problematic x: A clear string-like contamination was generated in the white background portion, and was practically problematic (Evaluation of Lifetime)

In a homogeneous film thickness portion of each of the photoreceptors (a portion obtained by removing a film thickness inhomogeneous portion of the photoreceptor in both end portions, on the basis of a film thickness distribution profile) before and after the durability test described above, 10 portions were randomly measured by using an eddy current type film thickness measuring machine (Product Name: "EDDY560C", manufactured by HELMUT FISCHER GMBTE), and the average value thereof was calculated, and was set to a film thickness (μm) of each of the photoreceptors. Then, a difference in the film thickness described above of each of the photoreceptors before and after the durability test described above, was set to a wear amount (μm). A wear amount per 100 krot (100000 rotations) was set to an α value (μm), and wear resistance was evaluated with respect to each of the photoreceptors, on the basis of the following standard. In a case where the evaluation result was "⊙", "○", and "Δ", it was determined as acceptable.

[Evaluation Standard]

⊙: The α value was less than 0.2

○: The α value was greater than or equal to 0.2 and less than 0.3

Δ: The α value was greater than or equal to 0.3 and less than 0.4 x: The α value was greater than or equal to 0.4

The evaluation results of the electrophotographic image forming apparatus are shown in Tables 3 and 4 described below. Furthermore, in Table 3 and Table 4, described below, Y, M, C, and K indicate that the colors of the toners of each of the image forming units respectively correspond to a yellow (Y) color, a magenta (M) color, a cyan (C) color, and a black (K) color. In addition, HU indicates the universal hardness of the organic photoreceptor, measured from the charge transfer layer side or the protective layer side, which is the outermost surface layer, on a side opposite to the conductive support body side, and the linear pressure indicates the linear pressure of the cleaning blade. Then, in Table 3 described below, when in the combinations of the two adjacent image forming units including the toners having colors different from each other, a difference obtained by subtracting the linear pressure P1 of the cleaning blade A included in the image forming unit disposed on the upstream side from the linear pressure P2 of the cleaning blade B included in the image forming unit disposed on the downstream side, exceeds 0 N/m, a "difference when P2>P1" indicates the value of the difference. Further, when in the combinations of the two adjacent image forming units including the toners having colors different from each other, a difference obtained by subtracting the universal hardness He of the organic photoreceptor C included in the image forming unit disposed on the upstream side from the universal hardness Hd of the organic photoreceptor D included in the image forming unit disposed on the downstream side, is greater than or equal to 10 N/mm$^2$, a "difference that Hd−He≥10" indicates the value of the difference.

TABLE 3

| Disposition of Organic Photoreceptor in Electrophotographic Image Forming Apparatus | | | | | | | | | | | | | | |
|---|---|---|---|---|---|---|---|---|---|---|---|---|---|---|
| | Upstream Side ← Disposition of Image Forming Unit ← Downstream Side | | | | | | | | | | | | | Difference |
| | Y Developer [4] | | | M Developer [3] | | | C Developer [2] | | | K Developer [1] | | | Difference When | That Hd − Hc ≥ |
| | Organic Photor-eceptor | HU (N/mm$^2$) | Linear Pressure (N/m) | Organic Photo-receptor | HU (N/mm$^2$) | Linear Pressure (N/m) | Organic Photo-receptor | HU (N/mm$^2$) | Linear Pressure (N/m) | Organic Photo-receptor | HU (N/mm$^2$) | Linear Pressure (N/m) | P2 > P1 (N/m) | 10 (N/mm$^2$) |
| Example 1 | [4] | 240 | 26 | [4] | 240 | 26 | [4] | 240 | 26 | [4] | 240 | 27 | 1 | — |
| Example 2 | [4] | 240 | 26 | [4] | 240 | 26 | [4] | 240 | 26 | [4] | 240 | 28 | 2 | — |
| Example 3 | [4] | 240 | 26 | [4] | 240 | 26 | [4] | 240 | 26 | [5] | 250 | 28 | 2 | 10 |
| Example 4 | [2] | 220 | 24 | [4] | 240 | 24 | [4] | 240 | 24 | [7] | 270 | 28 | 4 | 20, 30 |
| Example 5 | [3] | 230 | 26 | [4] | 240 | 26 | [5] | 250 | 28 | [6] | 260 | 28 | 2 | 10 |
| Example 6 | [1] | 180 | 24 | [2] | 220 | 26 | [6] | 260 | 28 | [9] | 300 | 30 | 2 | 40 |
| Example 7 | [2] | 220 | 22 | [5] | 250 | 24 | [8] | 280 | 27 | [10] | 320 | 31 | 2, 3, 4 | 30, 40 |
| Comparative Example 1 | [4] | 240 | 24 | [4] | 240 | 24 | [4] | 240 | 24 | [4] | 240 | 24 | — | — |
| Comparative Example 2 | [4] | 240 | 30 | [4] | 240 | 30 | [4] | 240 | 30 | [4] | 240 | 30 | — | — |

TABLE 4

| Evaluation Result of Electrophotographic Image Forming Apparatus | | | | | | | | |
|---|---|---|---|---|---|---|---|---|
| | Evaluation Result of Passing Through Upstream Side ← Disposition of Image Forming Unit ← Downstream Side | | | | Evaluation Result of Lifetime Upstream Side ← Disposition of Image Forming Unit ← Downstream Side | | | |
| | Y | M | C | K | Y | M | C | K |
| Example 1 | ○ | ○ | ○ | ○ | ◎ | ○ | ○ | Δ |
| Example 2 | ○ | ○ | ○ | ◎ | ◎ | ○ | ○ | Δ |
| Example 3 | ○ | ○ | ○ | ◎ | ◎ | ○ | ○ | ○ |
| Example 4 | ◎ | ◎ | ○ | ◎ | ○ | ◎ | ○ | ◎ |
| Example 5 | ○ | ○ | ◎ | ◎ | ◎ | ○ | ○ | ◎ |
| Example 6 | ◎ | ○ | ◎ | ◎ | Δ | ○ | ◎ | ○ |
| Example 7 | ◎ | ◎ | ◎ | ◎ | ◎ | ◎ | ◎ | ◎ |
| Comparative Example 1 | ◎ | ◎ | ○ | X | ◎ | ◎ | ○ | ○ |
| Comparative Example 2 | X | X | ○ | ◎ | ◎ | ○ | Δ | Δ |

From the results of Table 3 and Table 4, described above, according to the tandem type electrophotographic image forming apparatus of the invention, it was confirmed that the passing through of the toner was suppressed, and the lifetime of the organic photoreceptor and the apparatus itself was prolonged.

The embodiments of the invention have been described in detail, but it is obvious that the embodiments are illustrative and exemplary but not restrictive, and the scope of the invention is interpreted by the appended claims.

1Y, 1M, 1C, 1K photoreceptor
2Y, 2M, 2C, 2K charging means
3Y, 3M, 3C, 3K exposure means
4Y, 4M, 4C, 4K developing means
5Y, 5M, 5C, 5K primary transfer roller
5*b* secondary transfer roller
6Y, 6M, 6C, 6K, 6*b* cleaning means
10Y, 10M, 10C, 10K image forming unit
20 paper feeding cassette
21 paper feeding means
22A, 22B, 22C, 22D intermediate roller
23 resist roller
24 fixing means
25 paper discharge roller
26 paper discharge tray
30 blade member
31 support member
41Y developing sleeve of developing means 4Y
70 intermediate transfer body unit
71, 72, 73, 74 roller
77 intermediate transfer body
80 housing
82L, 82R support rail
A main body
SC original image reading device
P transfer material
100 organic photoreceptor
101 conductive support body
102 interlayer
103*a* charge generating layer
103*b* charge transfer layer
103 organic photosensitive layer
104 protective layer
200 measuring tool
201 load converter
202 pressure unit
203 cylindrical member

What is claimed is:

1. A tandem type electrophotographic image forming apparatus using an organic photoreceptor in which at least a charge generating layer and a charge transfer layer are sequentially laminated on a conductive support body, the apparatus comprising at least:

a plurality of image forming units including an electrostatic latent image forming means forming an electrostatic latent image on the organic photoreceptor, a developing means forming a toner image by supplying a toner to the organic photoreceptor, and by developing the electrostatic latent image, a lubricant supplying means supplying a lubricant to a front surface of the organic photoreceptor, and a cleaning means removing the toner remaining on the front surface of the organic photoreceptor with a cleaning blade, wherein when a linear pressure of a cleaning blade A included in the image forming unit disposed on an upstream side is set to P1, and a linear pressure of a cleaning blade B included in the image forming unit disposed on a downstream side is set to P2, at least one of combinations of the two adjacent image forming units including toners having colors different from each other satisfies Equation (1) described below.

[Expression 1]

$$P2>P1 \quad (1)$$

2. The electrophotographic image forming apparatus according to claim 1, wherein the linear pressure P1 of the cleaning blade A included in the image forming unit disposed on the upstream side, and the linear pressure P2 of the cleaning blade B included in the image forming unit disposed on the downstream side satisfy Equation (2) described below.

[Expression 2]

$$P2-P1\geq 2 \text{ N/m} \quad (2)$$

3. The electrophotographic image forming apparatus according to claim 1, wherein in the combinations of the two adjacent image forming units including the toners having colors different from each other, all of the combinations not satisfying Equation (1) described above satisfy Equation (3) described below.

[Expression 3]

$$P2=P1 \quad (3)$$

4. The electrophotographic image forming apparatus according to claim 1, wherein all of the combinations of the two adjacent image forming units having colors different from each other satisfy Equation (1) described above.

5. The electrophotographic image forming apparatus according to claim 1, wherein when a universal hardness of an organic photoreceptor C included in the image forming unit disposed on the upstream side is set to He, and a universal hardness of an organic photoreceptor D included in the image forming unit disposed on the downstream side is set to Hd, at least one of the combinations of the two adjacent image forming units including the toners having colors different from each other satisfies Equation (4) described below.

[Expression 4]

$$Hd-Hc\geq 10 \text{ N/mm}^2 \quad (4)$$

6. The electrophotographic image forming apparatus according to claim 1, wherein at least one of the organic photoreceptors further includes a protective layer on an outermost surface, and a universal hardness measured from the protective layer side is greater than or equal to 220 $N/mm^2$ and less than or equal to 320 $N/mm^2$.

7. The electrophotographic image forming apparatus according to claim 6, wherein the protective layer contains a cured resin component which is a cured material of a polymerizable compound.

8. The electrophotographic image forming apparatus according to claim 6, wherein the protective layer contains metal oxide particles.

9. The electrophotographic image forming apparatus according to claim 6, wherein the protective layer contains a charge transfer agent having a structure represented by General Formula (1) described below,

[Chemical Formula 1]

General Formula (1)

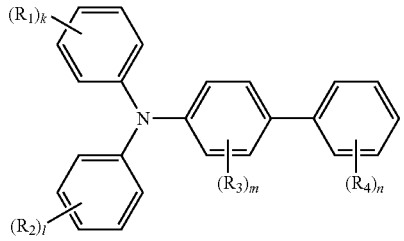

in General Formula (1), $R_1$, $R_2$, $R_3$, and $R_4$ each independently represent an alkyl group having 1 to 7 carbon atoms or an alkoxy group having 1 to 7 carbon atoms, k, l, and n each independently represent an integer of 0 to 5, m represents an integer of 0 to 4, and in a case in which k, l, n, or m is greater than or equal to 2, a plurality of $R_1$s, $R_2$s, $R_3$s, or $R_4$s may be identical to each other, or different from each other.

10. The electrophotographic image forming apparatus according to claim 6, wherein the protective layer contains a radical scavenger having a structure represented by General Formula (2) described below,

[Chemical Formula 2]

General Formula (2)

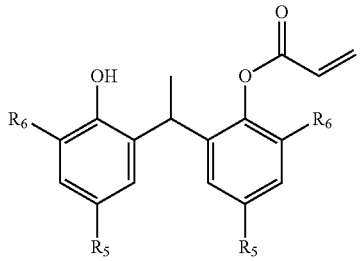

in General Formula (2) described above, $R_5$ and $R_6$ each independently represent an alkyl group having 1 to 6 carbon atoms.

11. The electrophotographic image forming apparatus according to claim 1, wherein the lubricant contains a fatty acid metal salt.

12. The electrophotographic image forming apparatus according to claim 1, wherein the lubricant supplying means is a means supplying the finely powdered lubricant contained in the toner to the organic photoreceptor, according to a function of a developing electrical field formed in the developing means.

* * * * *